US008005407B2

(12) United States Patent
Yamada

(10) Patent No.: US 8,005,407 B2
(45) Date of Patent: Aug. 23, 2011

(54) DEVELOPER APPARATUS WITH RESTRICTION MEMBER THAT RESTRICTS THICKNESS OF TONER LAYER ON TONER CARRIER ROLLER

(75) Inventor: Yoichi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 370 days.

(21) Appl. No.: 12/254,646

(22) Filed: Oct. 20, 2008

(65) Prior Publication Data

US 2009/0110445 A1 Apr. 30, 2009

(30) Foreign Application Priority Data

Oct. 26, 2007 (JP) ..... 2007-278969

(51) Int. Cl.
*G03G 15/08* (2006.01)
*G03G 15/095* (2006.01)

(52) U.S. Cl. ..... 399/284; 399/283; 399/264; 399/265

(58) Field of Classification Search ..... 399/284
See application file for complete search history.

(56) References Cited

U.S. PATENT DOCUMENTS

| | | | | |
|---|---|---|---|---|
| 4,780,741 | A * | 10/1988 | Wada et al. | 399/274 |
| 5,286,918 | A | 2/1994 | Iwata et al. | |
| 5,424,814 | A * | 6/1995 | Suzuki et al. | 399/284 |
| 5,502,552 | A * | 3/1996 | Iwata et al. | 399/222 |
| 5,805,966 | A * | 9/1998 | Yamada | 399/284 |
| 7,018,761 | B2 | 3/2006 | Yamanouchi et al. | |
| 7,366,434 | B2 * | 4/2008 | Ream et al. | 399/55 |
| 7,565,099 | B2 | 7/2009 | Yamada et al. | |
| 2001/0005461 | A1 | 6/2001 | Ichikawa et al. | |
| 2002/0003974 | A1 | 1/2002 | Nittani et al. | |
| 2004/0126692 | A1 | 7/2004 | Yamanouchi et al. | |
| 2004/0213603 | A1 | 10/2004 | Shigeta et al. | |
| 2005/0095037 | A1 | 5/2005 | Koike et al. | |

(Continued)

FOREIGN PATENT DOCUMENTS

EP 1998229 A1 12/2008

(Continued)

OTHER PUBLICATIONS

European Search Report for corresponding European application 08018678.6-1240 lists the references above.

*Primary Examiner* — David Gray
*Assistant Examiner* — David Bolduc
(74) *Attorney, Agent, or Firm* — DLA Piper LLP (US)

(57) ABSTRACT

A developer apparatus, includes: a container which houses toner; a toner carrier roller that is provided, on a surface thereof, with a plurality of convex sections which are regularly arranged and a concave section which surrounds the convex sections, is shaped approximately like a cylinder, and rotates while carrying a toner layer of charged toner on the surface thereof; and a restriction member that abuts on the surface of the toner carrier roller to form a restriction nip, restricts a thickness of the toner layer carried on the surface of the toner carrier roller in the restriction nip, and removes the toner layer on the convex sections from among the toner layer carried on the surface of the toner carrier roller at an upstream-side end of the restriction nip in a rotation direction of the toner carrier roller, wherein a part of toner carried by the concave section moves to the convex sections to cover the convex sections with the toner at a downstream side to the restriction nip in the rotation direction of the toner carrier roller.

13 Claims, 17 Drawing Sheets

U.S. PATENT DOCUMENTS

| | | | | |
|---|---|---|---|---|
| 2007/0110481 | A1 | 5/2007 | Yamada et al. | |
| 2007/0110484 | A1* | 5/2007 | Yamada et al. | 399/286 |
| 2007/0201907 | A1* | 8/2007 | Baba et al. | 399/274 |
| 2008/0273901 | A1* | 11/2008 | Toyama et al. | 399/286 |

FOREIGN PATENT DOCUMENTS

| | | | |
|---|---|---|---|
| GB | 2120960 | A | 12/1983 |
| JP | 2007-121949 | A | 5/2007 |
| JP | 2007147853 | A | 6/2007 |

* cited by examiner

FIG. 14A : INSULATING BLADE
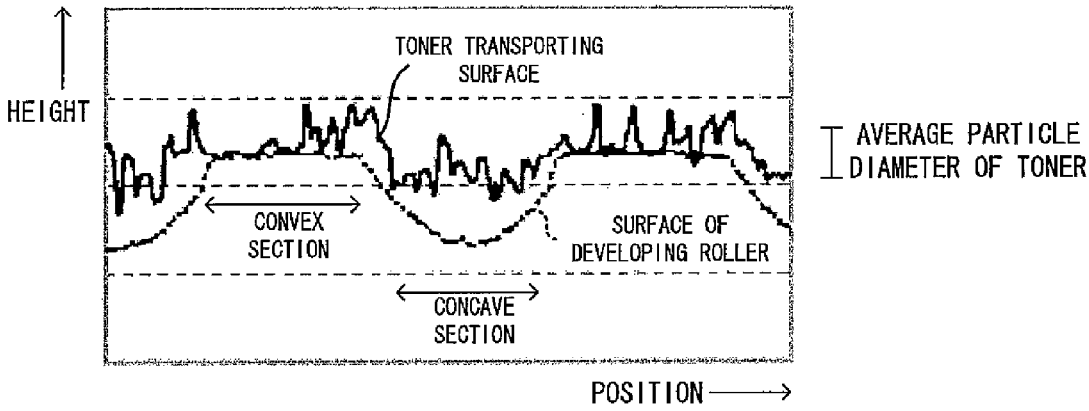
FIG. 14B : CONDUCTIVE BLADE (SAME POTENTIAL AS DEVELOPING ROLLER)
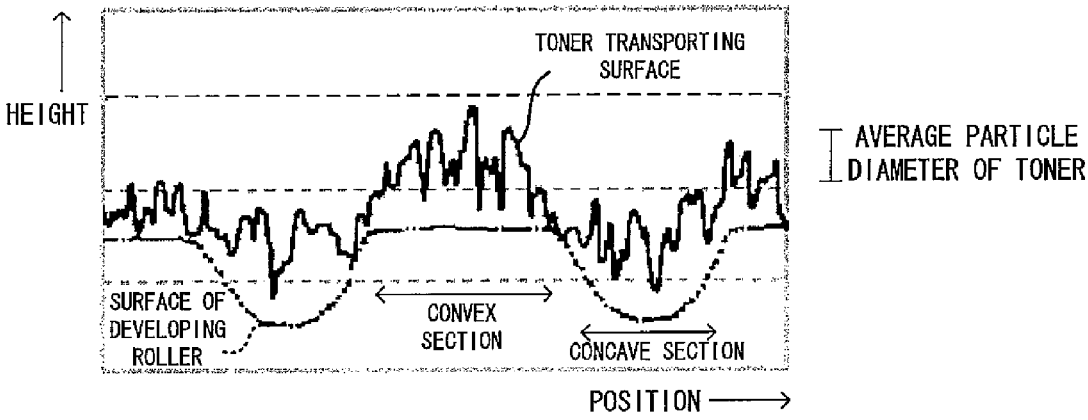

DEVELOPER APPARATUS WITH RESTRICTION MEMBER THAT RESTRICTS THICKNESS OF TONER LAYER ON TONER CARRIER ROLLER

CROSS REFERENCE TO RELATED APPLICATION

The disclosure of Japanese Patent Application No. 2007-278969 filed on Oct. 26, 2007 including specification, drawings and claims is incorporated herein by reference in its entirety.

BACKGROUND

1. Technical Field

The present invention relates to a developer apparatus which comprises a toner carrier roller which carries toner on a surface thereof, an image forming apparatus and a developing method of developing an electrostatic latent image with toner using this roller.

2. Related Art

Techniques for developing an electrostatic latent image with toner include an apparatus which causes a surface of a toner carrier roller to carry toner, the toner carrier roller being shaped approximately like a cylinder. For the purpose of improving the characteristics of toner carried on the surface of such a toner carrier roller, the applicant of the present application has earlier disclosed a structure of a toner carrier roller having a cylindrical shape that the surface of the roller includes convex sections which are regularly arranged and a concave section which surrounds the convex sections (JP-A-2007-127800). Since the concavo-convex patterns in the surface are regulated and uniform, such a structure is advantageous in that it permits easy control of the thickness of a toner layer which is carried on the surface of the roller, the charge level and the like.

SUMMARY

In the case where a toner carrier roller having the structure above is used, for the purpose of preventing toner carried by the convex sections from getting deteriorated due to friction contact with a restriction member and the like which regulates a thickness of a toner layer, only the concave section may carry toner. With such a structure, toner carried by the concave section is free from friction contact with or pressing force from the restriction member. Hence, toner hardly deteriorates, which makes it possible to retain initial toner characteristics for a long period of time. In addition, development is performed with toner which is not under pressing force. Therefore, it is possible to prevent excessive charging of toner and to improve an image quality by improving efficiency of development, suppressing a memory phenomenon after formation of a high-density image, and the like.

However, since such a structure exposes the convex sections of the toner carrier roller, there arise a problem that discharge easily occurs between the toner carrier roller and a latent image carrier particularly when the toner carrier roller is made of a conductive material. From the viewpoint of prevention of discharge, it is desirable that toner which is an insulator covers the entire surface of the toner carrier roller.

As described above, when a toner carrier roller which is provided with convex sections and a concave section on its surface is used, it is desirable that the convex sections do not carry toner for prevention of toner degradation, whereas there is a contradicting demand that the convex sections as well should carry toner for prevention of discharge. No technique has been established that satisfies the both needs.

An advantage of some aspects of the invention is to provide a technique for prevention of both toner degradation and discharge in a developer apparatus, an image forming apparatus and a developing method which use a toner carrier roller which is provided with concavo-convex on its surface.

According to a first aspect of the invention, there is provided a developer apparatus, comprising: a container which houses toner; a toner carrier roller that is provided, on a surface thereof, with a plurality of convex sections which are regularly arranged and a concave section which surrounds the convex sections, is shaped approximately like a cylinder, and rotates while carrying a toner layer of charged toner on the surface thereof; and a restriction member that abuts on the surface of the toner carrier roller to form a restriction nip, restricts a thickness of the toner layer carried on the surface of the toner carrier roller in the restriction nip, and removes the toner layer on the convex sections from among the toner layer carried on the surface of the toner carrier roller at an upstream-side end of the restriction nip in a rotation direction of the toner carrier roller, wherein a part of toner carried by the concave section moves to the convex sections to cover the convex sections with the toner at a downstream side to the restriction nip in the rotation direction of the toner carrier roller.

According to a second aspect of the invention, there is provided an image forming apparatus, comprising: an image carrier that carries an electrostatic latent image; a developer that includes a toner carrier roller and a restriction member, the toner carrier roller being provided, on a surface thereof, with a plurality of convex sections which are regularly arranged and a concave section which surrounds the convex sections, being made of a conductive material, being shaped approximately like a cylinder, and rotating while carrying a toner layer of charged toner on the surface thereof to transport the toner layer to an opposed position against the image carrier, the restriction member abutting on the surface of the toner carrier roller to form a restriction nip, and restricting a thickness of the toner layer carried on the surface of the toner carrier roller in the restriction nip; and a bias applier that applies a predetermined developing bias to the toner carrier roller to develop the electrostatic latent image carried on the image carrier with the toner, wherein toner is not carried on the convex sections within the surface of the toner carrier roller at an upstream-side end of the restriction nip in the rotation direction of the toner carrier roller, whereas toner carried on the concave section is partially moved to the convex sections to cover the convex sections at a downstream side to the restriction nip and at an upstream side to the opposed position against the image carrier in the rotation direction of the toner carrier roller.

According to a third aspect of the invention, there is provided a developing method, comprising: rotating a toner carrier roller that is provided, on a surface thereof with a plurality of convex sections which are regularly arranged and a concave section which surrounds the convex sections, is shaped approximately like a cylinder, and carries a toner layer of charged toner on the surface thereof to transport the toner layer to an opposed position against an image carrier which carries an electrostatic latent image; developing the electrostatic latent image with the toner; preventing the convex sections within the surface of the toner carrier roller from carrying toner at an upstream-side end of the restriction nip in a rotation direction of the toner carrier roller; and covering the convex sections with toner which has been carried on the concave section and has partially moved to the convex sections at a downstream side to the restriction nip and at an upstream side to the opposed position against the image carrier in the rotation direction of the toner carrier roller.

In the invention structured as above, since toner carried on the convex sections is removed at the upstream side to the restriction nip, the convex sections do not carry toner in the restriction nip. This makes it possible to avoid a problem such as toner clumping together due to toner particles pressed to each other in the restriction nip and toner degradation which is caused by friction contact in the restriction nip. Further, since toner carried on the concave section is partially moved to the convex sections at the downstream side to the restriction nip, it is possible to prevent from causing discharge which is attributable to the fact that the convex sections are exposed. In this manner, it is possible according to the invention to prevent discharge while suppressing deterioration of toner attributable to friction contact of the toner with the restriction member.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 14A and 14B are graphs showing cross sectional profiles of the developing roller after the developing roller has moved past the restriction nip.

DESCRIPTION OF EXEMPLARY EMBODIMENTS

Figure 1:
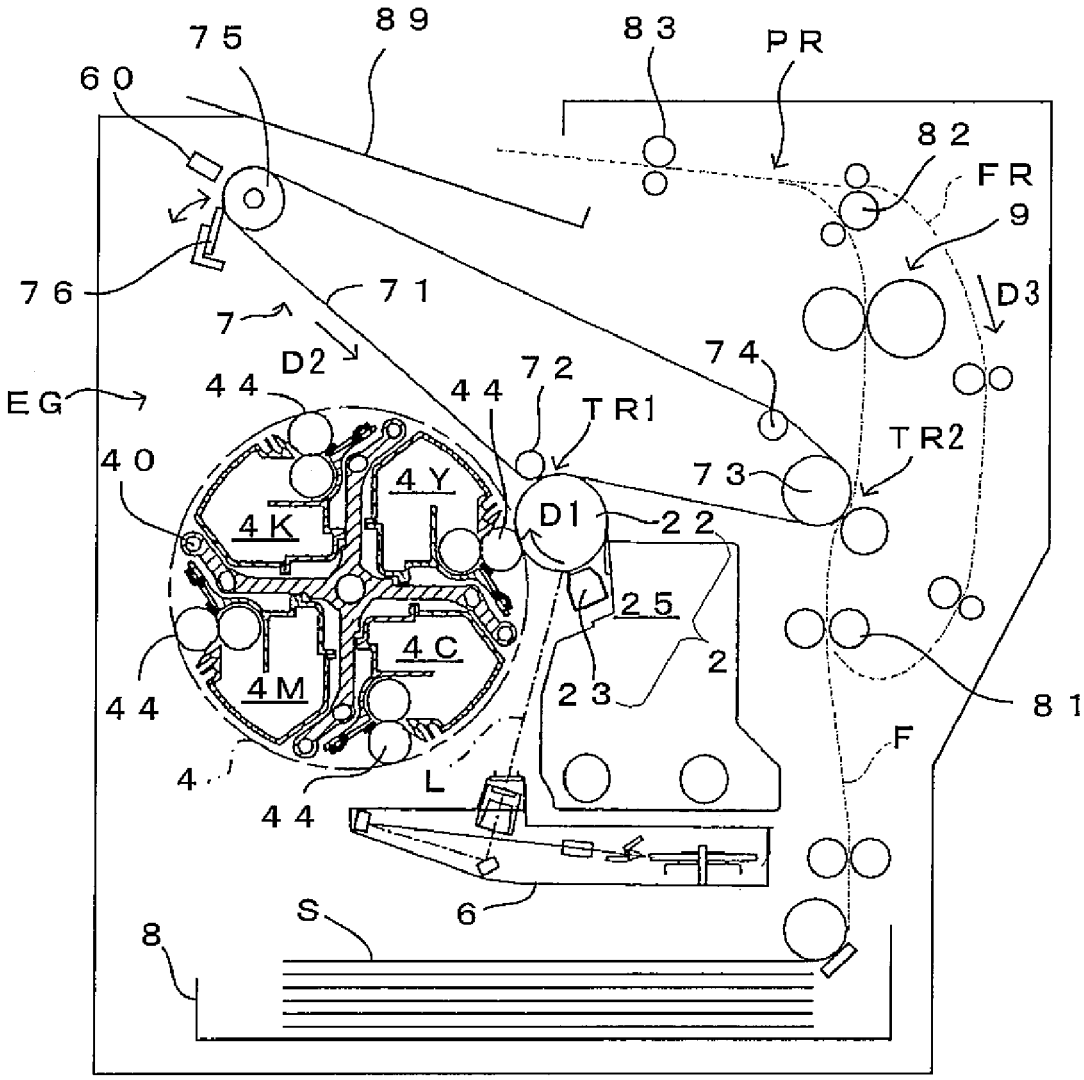
FIG. 1 is a diagram showing a first embodiment of an image forming apparatus according to the invention.
Figure 2:
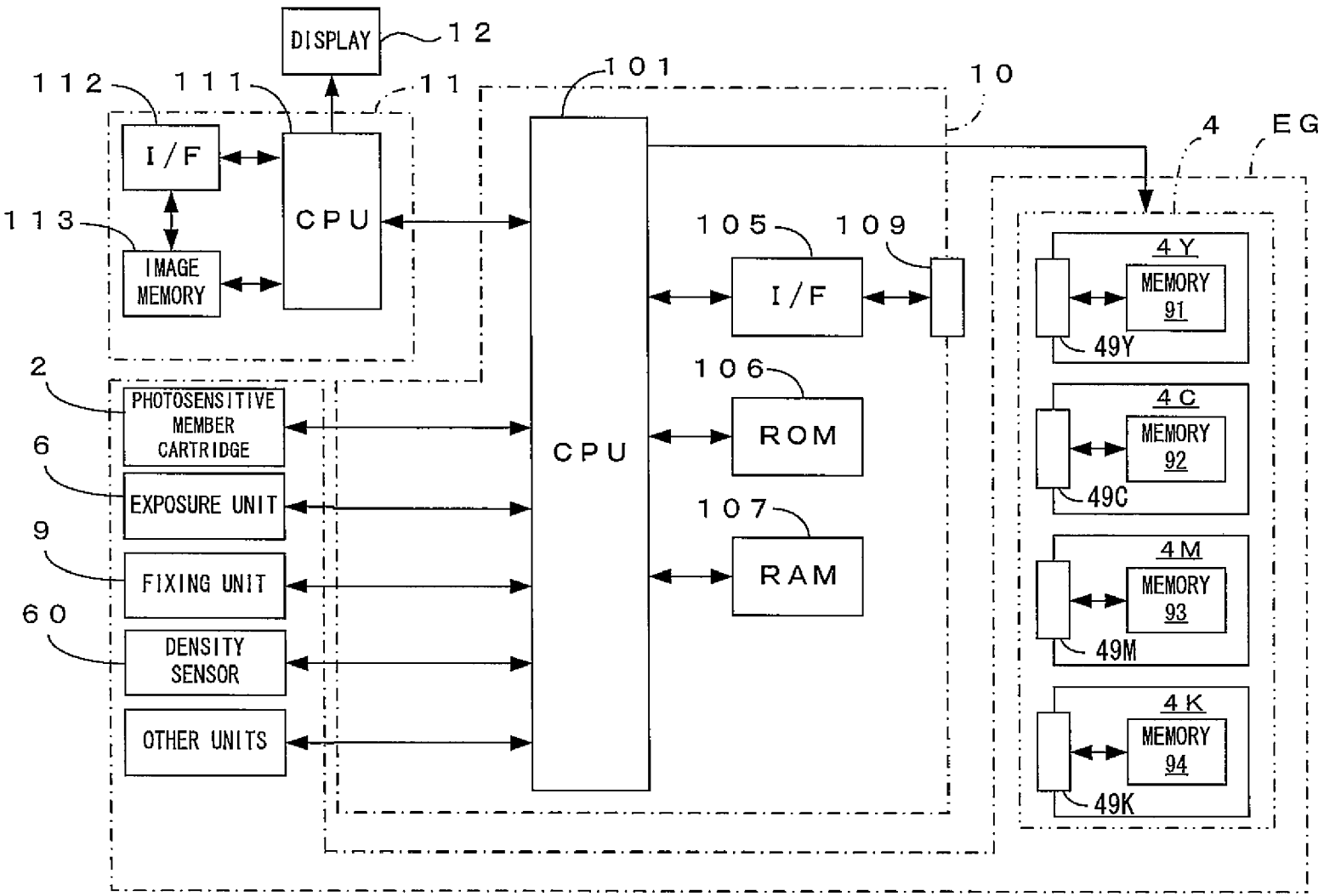
FIG. 2 is a block diagram of an electric structure of the image forming apparatus which is shown in FIG. 1.

FIG. 1 is a diagram showing a first embodiment of an image forming apparatus according to the invention. FIG. 2 is a block diagram of an electric structure of the image forming apparatus which is shown in FIG. 1. This apparatus is an image forming apparatus which overlays toner in four colors of yellow (Y), cyan (C), magenta (M) and black (K) one atop the other and accordingly forms a full-color image, or forms a monochrome image using only black toner (K). In the image forming apparatus, when an image signal is fed to a main controller 11 from an external apparatus such as a host computer, a CPU 101 provided in an engine controller 10 controls respective portions of an engine part EG in accordance with an instruction received from the main controller 11 to perform a predetermined image forming operation, and accordingly, an image which corresponds to the image signal is formed on a sheet S.

In the engine part EG, a photosensitive member 22 is disposed so that the photosensitive member 22 can freely rotate in an arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a waste toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from an apparatus main body as one integrated unit.

An exposure unit 6 emits a light beam L toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The developer unit 4 develops thus formed electrostatic latent image with toner. Specifically, the developer unit 4 includes a support frame 40 which is provided rotatable about a rotation shaft orthogonal to a plane of FIG. 1 and a yellow developer 4Y, a cyan developer 4C, a magenta developer 4M and a black developer 4K which are freely attachable to and detachable from the support frame 40 and house toner of the respective colors. An engine controller 10 controls the developer unit 4. The developer unit 4 is driven into rotation based on a control instruction from the engine controller 10. When the developers 4Y, 4C, 4M and 4K are selectively positioned at a predetermined developing position which is faced with the photosensitive member 22 over a predetermined gap, the developing roller 44 which is disposed in this developer and carries a toner of a selected color is positioned facing the photosensitive member 22, and the developing roller 44 supplies the toner onto the surface of the photosensitive member 22 at the facing position. As a result, the electrostatic latent image on the photosensitive member 22 is visualized with the toner of the selected color.

Figure 3:
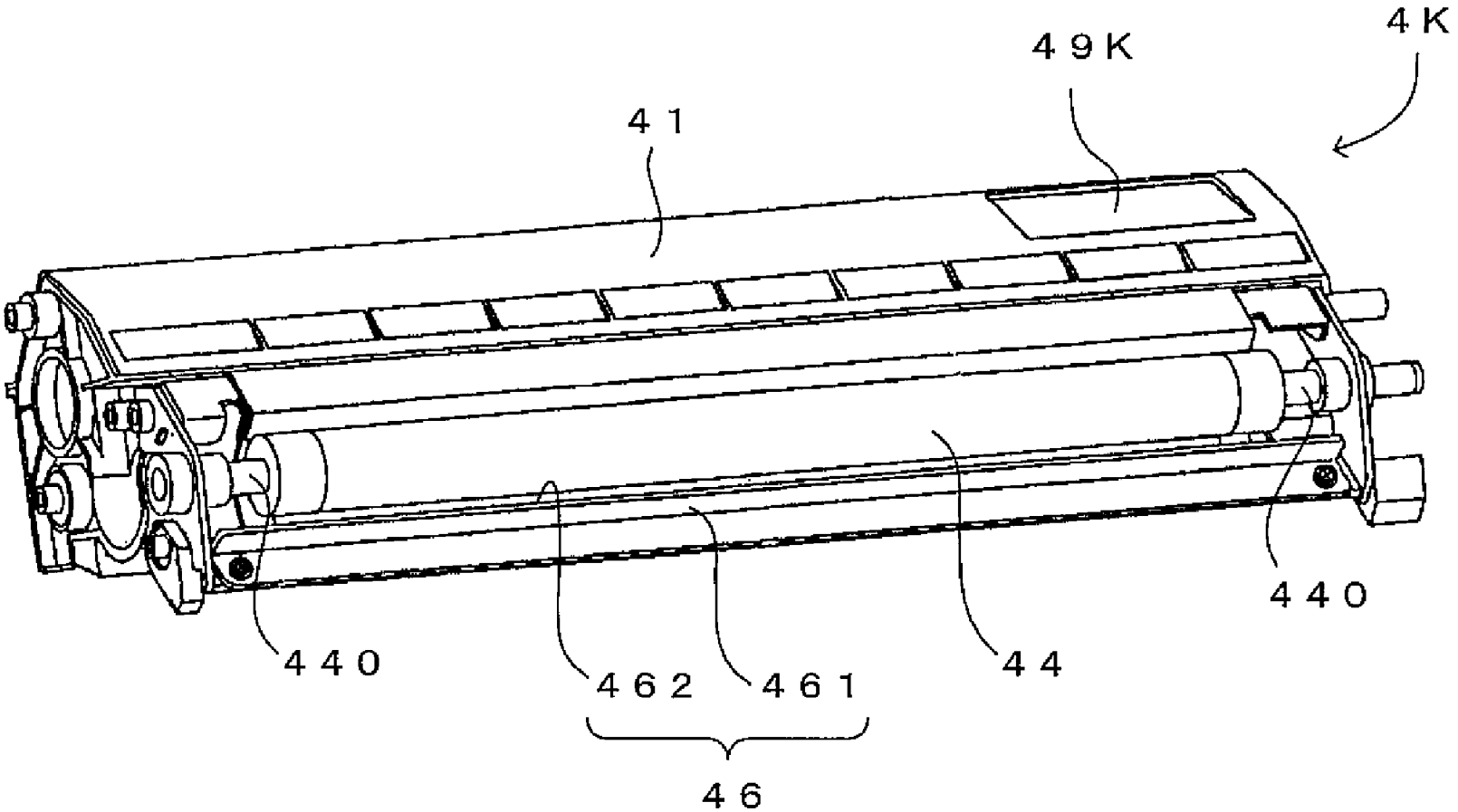
FIG. 3 is a diagram showing the appearance of the developer.
Figure 4A:
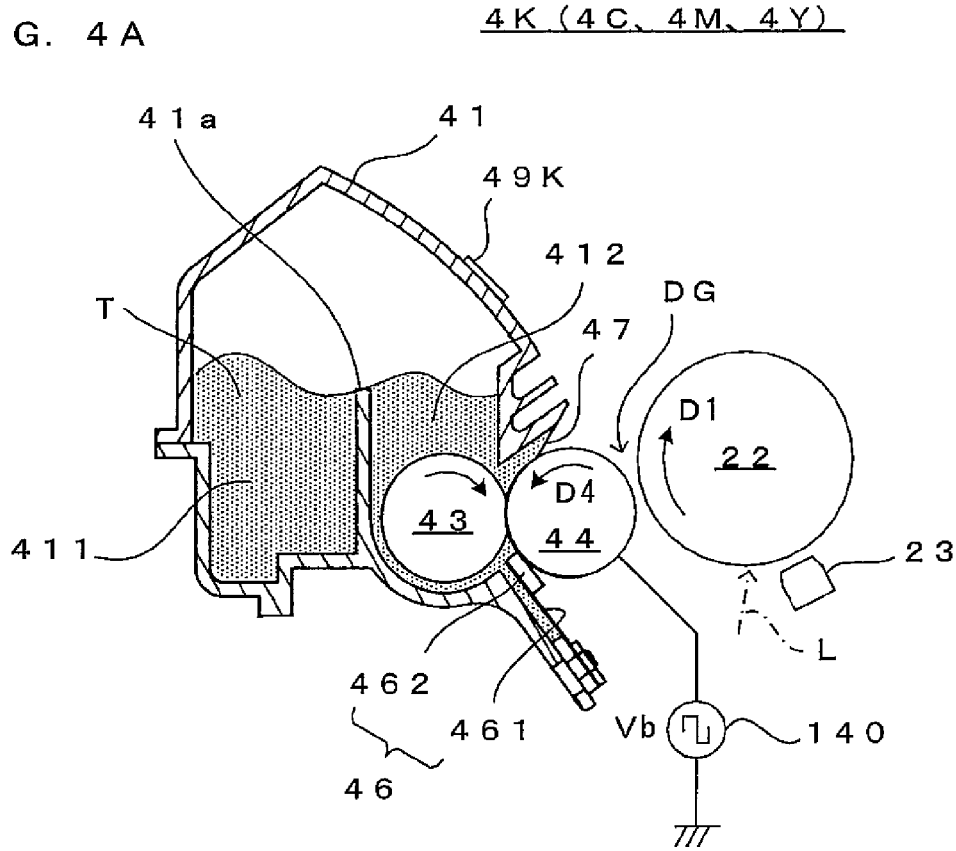
FIG. 4A is a cross sectional view showing a structure of the developer.
Figure 4B:
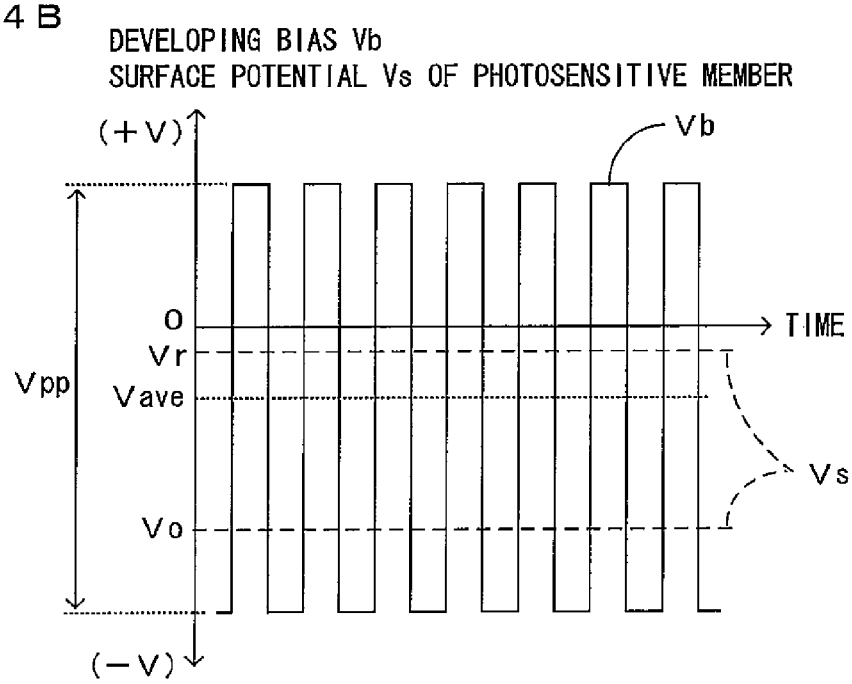
FIG. 4B is a graph showing the relationship between a waveform of a developing bias and a surface potential of the photosensitive member.

FIG. 3 is a diagram showing the appearance of the developer. FIG. 4A is a cross sectional view showing a structure of the developer, and FIG. 4B is a graph showing the relationship between a waveform of a developing bias and a surface potential of the photosensitive member. The developers 4Y, 4C, 4M and 4K have identical structures. Therefore, the structure of the developer 4K will now be described in further detail with reference to FIGS. 3 and 4A. The other developers 4Y, 4C and 4M have the same structures and functions, to be noted.

In the developer 4K, a feed roller 43 and a developing roller 44 are rotatably attached with a shaft to a housing 41 which houses monocomponent toner T inside. When the developer 4K is positioned at the developing position described above, the developing roller 44 is positioned at a facing position which is faced with the photosensitive member 22 over a developing gap DG, and these rollers 43 and 44 are engaged with a rotation driver (not shown) which is provided in the main body to rotate in a predetermined direction. The feed roller 43 is shaped like a cylinder and is made of an elastic material such as foamed urethane rubber and silicone rubber. The developing roller 44 is shaped like a cylinder and is made of metal or alloy such as copper, aluminum and stainless steel. The two rollers 43 and 44 rotate while staying in contact with each other, and accordingly, the toner is rubbed against the surface of the developing roller 44 and a toner layer having a predetermined thickness is formed on the surface of the developing roller 44. Although negatively-charged toner is used in this embodiment, positively-charged toner may be used instead.

The space inside the housing 41 is divided by a partition wall 41*a* into a first chamber 411 and a second chamber 412. The feed roller 43 and the developing roller 44 are both provided in the second chamber 412. With a rotation of these rollers, toner within the second chamber 412 flows and is fed to the surface of the developing roller 44 while getting agitated. Meanwhile toner stored inside the first chamber 411 would not be moved by the rotation since it is isolated from the feed roller 43 and the developing roller 44. This toner is mixed with toner stored in the second chamber 412 and is agitated by the rotation of the developer unit 4 while holding the developer.

As described above, in this developer, the inside of the housing is separated into the two chambers, and the side walls of the housing 41 and the partition wall 41*a* surround the feed roller 43 and the developing roller 44, and accordingly, the second chamber 412 of relatively small volume is provided. Therefore, even when a remaining toner amount is small, toner is supplied efficiently to near the developing roller 44. Further, supply of toner from the first chamber 411 to the second chamber 412 and agitation of the whole toner are performed by the rotation of the developer unit 4. Hence, an auger-less structure is realized that an agitator member (auger) for agitating toner is not provided inside the developer.

Further, in the developer 4K, a restriction blade 46 is disposed which restricts the thickness of the toner layer formed on the surface of the developing roller 44 into the predetermined thickness. The restriction blade 46 includes a plate-like member 461 made of elastic material such as stainless steel, phosphor bronze or the like and an elastic member 462 which is attached to a front edge of the plate-like member 461 and is made of a resin member such as silicone rubber and a urethane rubber. A rear edge of the plate-like member 461 is fixed to the housing 41. The elastic member 462 attached to the front edge of the plate-like member 461 is positioned on the upstream side to the rear edge of the plate-like member 461 in a rotation direction D4 of the developing roller 44 shown by an arrow in FIG. 4. The elastic member 462 elastically abuts on the surface of the developing roller 44 to form a restriction nip, thereby restricting the toner layer formed on the surface of the developing roller 44 finally into the predetermined thickness.

The toner layers thus formed on the surface of the developing roller 44 are transported, by means of the rotation of the developing roller 44, one after another to the opposed positions against the photosensitive member 22 on the surface of which an electrostatic latent image is formed. The developing bias from a bias power source 140 controlled by the engine controller 10 is applied to the developing roller 44. As shown in FIG. 4B, a surface potential Vs of the photosensitive member 22 drops down approximately to a residual potential Vr at exposed segments exposed by the light beam L from the exposure unit 6 after getting uniformly charged by the charger unit 23, but stays at an almost uniform potential V0 at non-exposed segments not exposed by the light beam L. Meanwhile, the developing bias Vb applied to the developing roller 44 is rectangular-wave AC voltage on which a DC potential Vave is superimposed, and its peak-to-peak voltage will be hereinafter denoted at Vpp. With application of such a developing bias Vb, toner carried on the developing roller 44 is made jump across a developing gap DG and partially adheres to the respective sections in the surface of the photosensitive member 22 in accordance with the surface potential Vs of the photosensitive member 22, whereby an electrostatic latent image on the photosensitive member 22 is visualized as a toner image in the color of the toner.

The housing 41 further includes a seal member 47 which is pressed against the surface of the developing roller 44 on the downstream side to the opposed position facing the photosensitive member 22 in the rotation direction of the developing roller 44. The seal member 47 guides toner which remains on the surface of the developing roller 44 after moving past the opposed position facing the photosensitive member 22 to inside the housing 41 and prevents toner inside the housing from leaking to outside.

Figure 5:
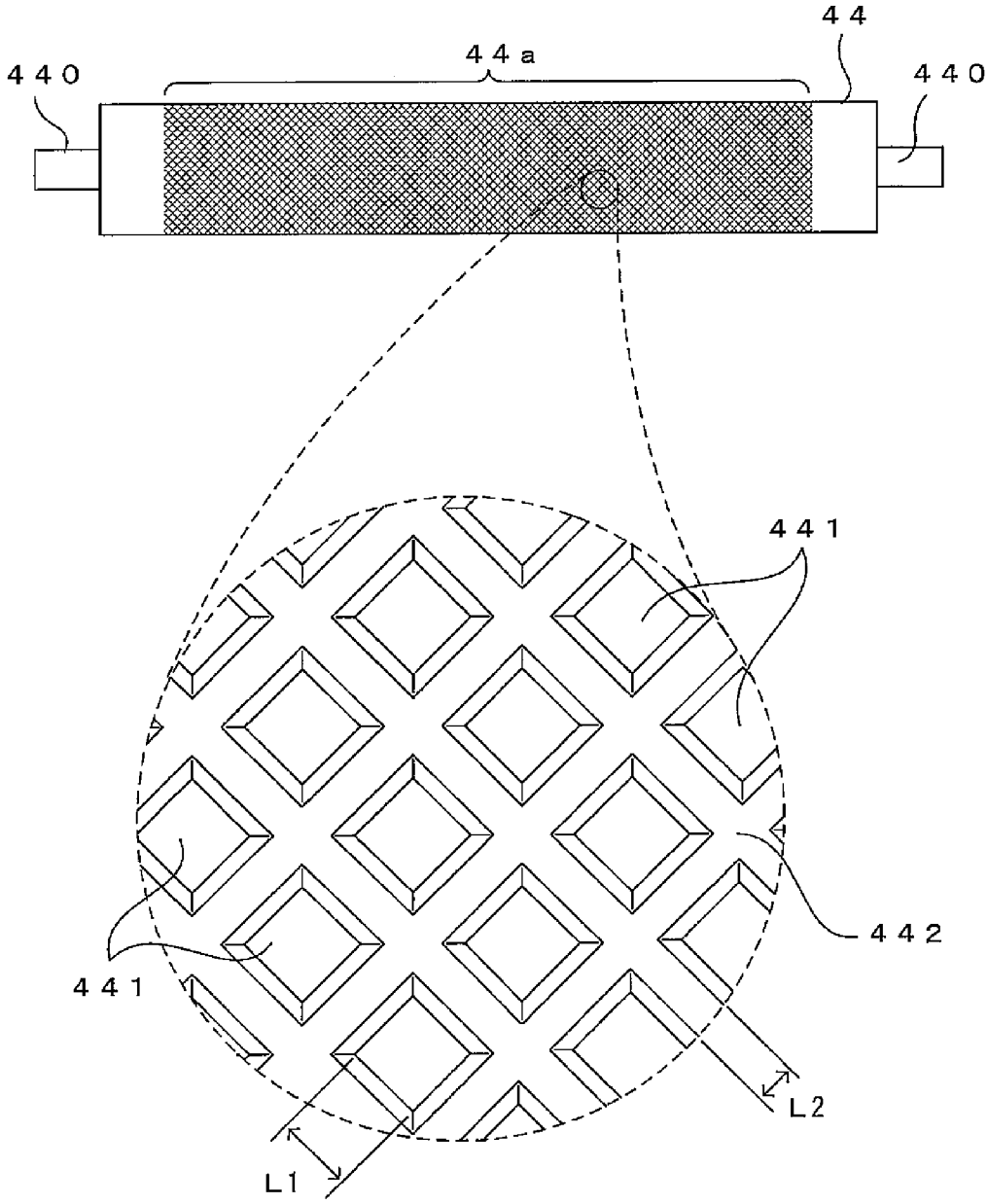
FIG. 5 is a group of diagrams showing a side view of the developing roller and a partially expanded view of the surface of the developing roller.

FIG. 5 is a group of diagrams showing a side view of the developing roller and a partially expanded view of the surface of the developing roller. The developing roller 44 is shaped like an approximately cylindrical roller. A shaft 440 is provided at the both ends of the roller in the longitudinal direction of the roller such that the shaft is coaxial with the roller. With the shaft 440 supported by the developer main body, the entire developing roller 44 is freely rotatable A central area 44*a* in the surface of the developing roller 44, as shown in the partially expanded view in FIG. 5 (inside the dotted-line circle), is provided with a plurality of convex sections 441 which are regularly arranged and a concave section 442 which surrounds the convex sections 441.

Each one of the convex sections 441 projects forward from the plane of FIG. 5, and a top surface of each convex section 441 forms a part of a single cylindrical surface which is coaxial with a rotation shaft of the developing roller 44. The concave section 442 is a continuous groove which surrounds the convex sections 441 like a net. The entire concave section 442 also forms a single cylindrical surface which is different from the cylindrical surface which is made by the convex sections and is coaxial with the rotation shaft of the developing roller 44. The developing roller 44 having such a structure may be made by the manufacturing method described in JP-A-2007-140080 for instance.

The length L1 of a side of the top surface of each convex section 441 and a distance L2 between the respective convex sections are preferably larger than a particle diameter of toner and may be but are not limited to 10 through 100 μm approximately for instance. The shape, the arrangement and the like of the convex sections 441 are not limited to those described here. A difference in height between the convex sections 441 and the concave section 442 will be described later.

Referring back to FIG. 1, the description of the image forming apparatus is continued. The toner image developed by the developer unit 4 as described above is primarily transferred onto an intermediate transfer belt 71 of a transfer unit 7 in a primary transfer region TR1. The transfer unit 7 includes the intermediate transfer belt 71 mounted on a plurality of rollers 72 to 75 and a driver (not shown) for driving the roller 73 into rotation to rotate the intermediate transfer belt 71 in a specified rotating direction D2. In the case of transferring a color image onto the sheet S, the toner images of the respective colors formed on the photosensitive member 22 are superimposed on the intermediate transfer belt 71 to form the color image, which is secondarily transferred onto the sheet S dispensed one by one from a cassette 8 and conveyed to a secondary transfer region TR2 along a conveyance path F.

At this time, for the purpose of correctly transferring the image on the intermediate transfer belt 71 onto the sheet S at a predetermined position, the timing of feeding the sheet S into the secondary transfer region TR2 is controlled. To be more specific, there is a gate roller 81 disposed in front of the secondary transfer region TR2 on the transportation path F. The gate roller 81 starts to rotate in accordance with the timing of rotation of the intermediate transfer belt 71, and accordingly, the sheet S is fed into the secondary transfer region TR2 at a predetermined timing.

Further, the sheet S on which the color image is thus formed is transported to a discharge tray 89 which is disposed at a top surface of the apparatus main body via a pre-discharge roller 82 and a discharge roller 83 after the toner image is fixed to the sheet S by a fixing unit 9. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. The sheet S is returned back to the transportation path F again before arriving at the gate roller 81. At this time, the surface of the sheet S which abuts on the intermediate transfer belt 71 in the secondary transfer region TR2 and is to receive a transferred image is opposite to the surface which already carries the image. In this fashion, it is possible to form images on the both surfaces of the sheet S.

Further, as shown in FIG. 2, the respective developers 4Y, 4C, 4M and 4K comprise memories 91, 92, 93 and 94 respectively which store data related to the production lot, the use history, the remaining toner amount and the like of the developers. In addition, wireless telecommunication devices 49Y, 49C, 49M and 49K are provided in the developers 4Y, 4C, 4M and 4K, respectively. When necessary, the telecommunication devices selectively perform non-contact data telecommunication with a wireless telecommunication device 109 which is provided in the apparatus main body, whereby data transmission between the CPU 101 and the memories 91 through 94 via the interface 105 is performed to manage various types of information regarding the developers such as management of consumables. Meanwhile, in this embodiment, non-contact data transmission using electromagnetic scheme such as wireless telecommunication is performed. However, the apparatus main body and each developer may be provided with connectors and the like, and the connectors may be engaged mechanically to perform data transmission between each other.

Further, as shown in FIG. 2, the apparatus includes a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, and the like in accordance with the control command from the CPU 111.

In FIG. 2, a reference numeral 113 represents an image memory provided in the main controller 11 in order to store the image supplied from the external apparatus, such as a host computer, via the interface 112. A reference numeral 106 represents a ROM for storage of an operation program executed by the CPU 101 and control data used for controlling the engine EG. A reference numeral 107 represents a RAM for temporary storage of operation results given by the CPU 101 and other data.

Further, there is a cleaner 76 in the vicinity of the roller 75. The cleaner 76 moves nearer to and away from the roller 75 driven by an electromagnetic clutch not shown. In a condition that the cleaner 76 is moved nearer to the roller 75, a blade of the cleaner 76 abuts on the surface of the intermediate transfer belt 71 mounted on the roller 75 and scrapes off the toner remaining on and adhering to the outer circumferential surface of the intermediate transfer belt 71 after the secondary transfer.

Furthermore, a density sensor 60 is disposed in the vicinity of the roller 75. The density sensor 60 confronts a surface of the intermediate transfer belt 71 and measures, as needed, the density of the toner image formed on the outer circumferential surface of the intermediate transfer belt 71. Based on the measurement results, the apparatus adjusts the operating conditions of the individual parts thereof that affects the image quality such as a developing bias applied to each developer, the intensity of the exposure beam L, and tone-correction characteristics of the apparatus, for example.

The density sensor 60 is structured to output a signal corresponding to a contrasting density of a region of a predetermined area defined on the intermediate transfer belt 71 using a reflective optical sensor, for example. The CPU 101 is adapted to detect image densities of individual parts of the toner image on the intermediate transfer belt 71 by periodically sampling the output signals from the density sensor 60 while moving the intermediate transfer belt 71 in rotation.

Restriction of a toner layer on the developing roller 44 within the developer 4K, . . . of the image forming apparatus having the structure above will now be described in detail. In a structure as that described above in which the surface of the developing roller 44 for carrying toner has concavity and convexity, it is possible for both the convex sections 441 and the concave section 442 of the developing roller 44 to carry toner. However, in this embodiment, it is structured that the restriction blade 46 abuts on the developing roller 44 within the surface of the developing roller 44 directly to remove toner on the convex sections 441. The reason is as described below.

First, the distance between the restriction blade 46 and the convex sections 441 needs be controlled precisely in order to form a uniform toner layer on the convex sections 441. However, for carrying of toner only by the concave section 442, the restriction blade 46 may abut on the convex sections 441 and remove all toner on the convex sections 441, which can be realized relatively easily. Further, since the volume of the space defined between the restriction blade 46 and the concave section 442 determines the amount of transported toner, it is possible to stabilize a transported toner amount.

This provides another advantage with respect to superiority of a transported toner layer. That is, carrying of toner by the convex sections 441 tends to degrade toner because of friction contact of the toner with the restriction blade 46. More specifically, there are problems such as reduction of the fluidity and the charging performance of toner, clumping together due to toner particles pressed to each other, and filming due to fixedly adherence of toner to the developing roller 44. In contrast, carrying of toner by the concave section 442 which is less influenced by the pressure from the restriction blade 46 is less likely to give rise to such problems. Further, the manner of friction contact on the restriction blade 46 is greatly different between toner carried by the convex sections 441 and toner carried by the concave section 442. Hence, their charge levels are predicted to largely vary from each other. However, carrying of toner by the concave section 442 alone makes it possible to suppress such variations.

The recent years in particular have seen a growing demand for size reduction of toner particles and a lower fixing temperature to enhance the resolution of an image and reduce the amount of consumed toner and electric power consumption. The structure in this embodiment meets the demand. Small-particle toner generally has a high saturation charge level but gets charged slowly at the beginning, and hence, of toner carried by the convex sections 441, a portion which has not contributed to previous development has an increased charge level. On the other hand, new toner held inside the developer is fed onto the developing roller 44 in a part which carried toner that has contributed to previous development. However, since the new toner is charged up slowly at the beginning, its charge level will not immediately reach the charge level of the other part of toner.

The presence of segments having different toner charge levels on the developing roller 44 leads to local image density variations (the development history, the memory phenomenon), density variations corresponding to the rotation cycle of the developing roller 44 during formation of a solid image for instance. The workload is increased through adjustment of the rotation frequency and the pressure force of the feed roller 43 and the reset performance of the feed roller 43 is enhanced, and accordingly, such a phenomenon is beginning to be improved. However, this causes different problems that the drive torque of the developing roller 44 increases and toner degrades faster. With respect to toner having a low melting point, fixing of toner to each other and fixing of the toner to the developing roller 44 and the like could occur by the friction contact of toner with each other and with the developing roller 44. However, such a problem is less likely to occur where the structure according to the embodiment is used in which only the concave section 442 carries toner.

Meanwhile, removal of toner from the convex sections 441 reduces the transported toner amount transported by the developing roller 44 as a whole. This gives rise to other problem that a discharge inception voltage decreases in the developing gap DG.

Figure 6A:
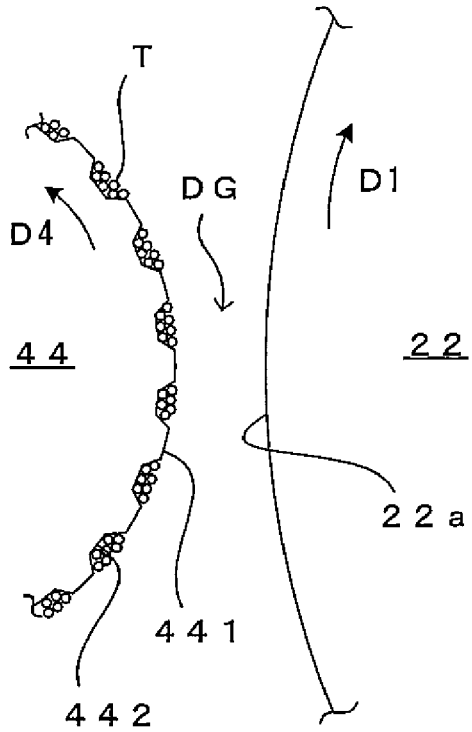
FIGS. 6A and 6B are diagrams describing the relationship between a toner layer and a discharge in the developing gap.
Figure 6B:
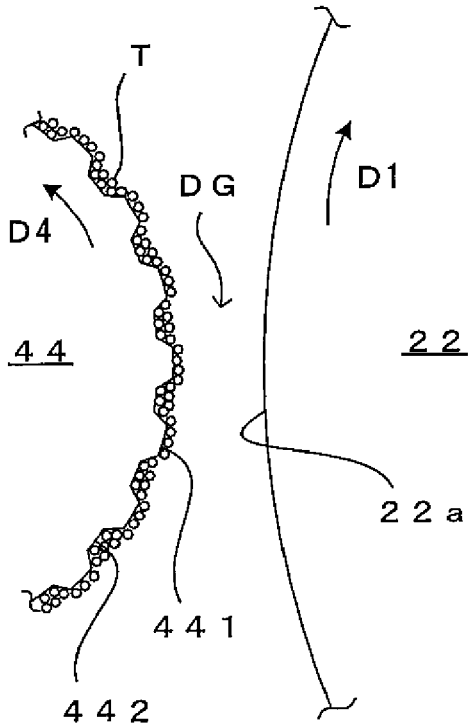

FIGS. 6A and 6B are diagrams describing the relationship between a toner layer and a discharge in the developing gap. As described above, in terms of superiority of a toner layer carried by the surface of the developing roller 44, it is desirable that the concave section 442 alone carries toner but the convex sections 441 do not carry toner as shown in FIG. 6A. However, this exposes the convex sections 441, which are portions of the metallic developing roller 44, to the surface 22*a* of the photosensitive member 22 within the developing gap DG, and causes discharge in the developing gap DG depending upon which one of the developing bias Vb and the surface potential Vs of the photosensitive member is larger than the other. This indicates that a toner layer on the surface of the developing roller, serving as a dielectric layer, has an effect to suppress discharge and that a condition of toner covering the surface of the developing roller is an important factor for prevention of discharge.

Reduction of the developing bias Vb, and more particularly, its peak-to-peak voltage Vpp is effective for prevention of discharge. However, a lower developing bias makes it harder for toner to jump across the developing gap DG, and accordingly, the density, the quality and the like of an image are reduced. Other method to prevent discharge is to cover the entire surface of the developing roller 44 with toner T as shown in FIG. 6B.

Figure 7:
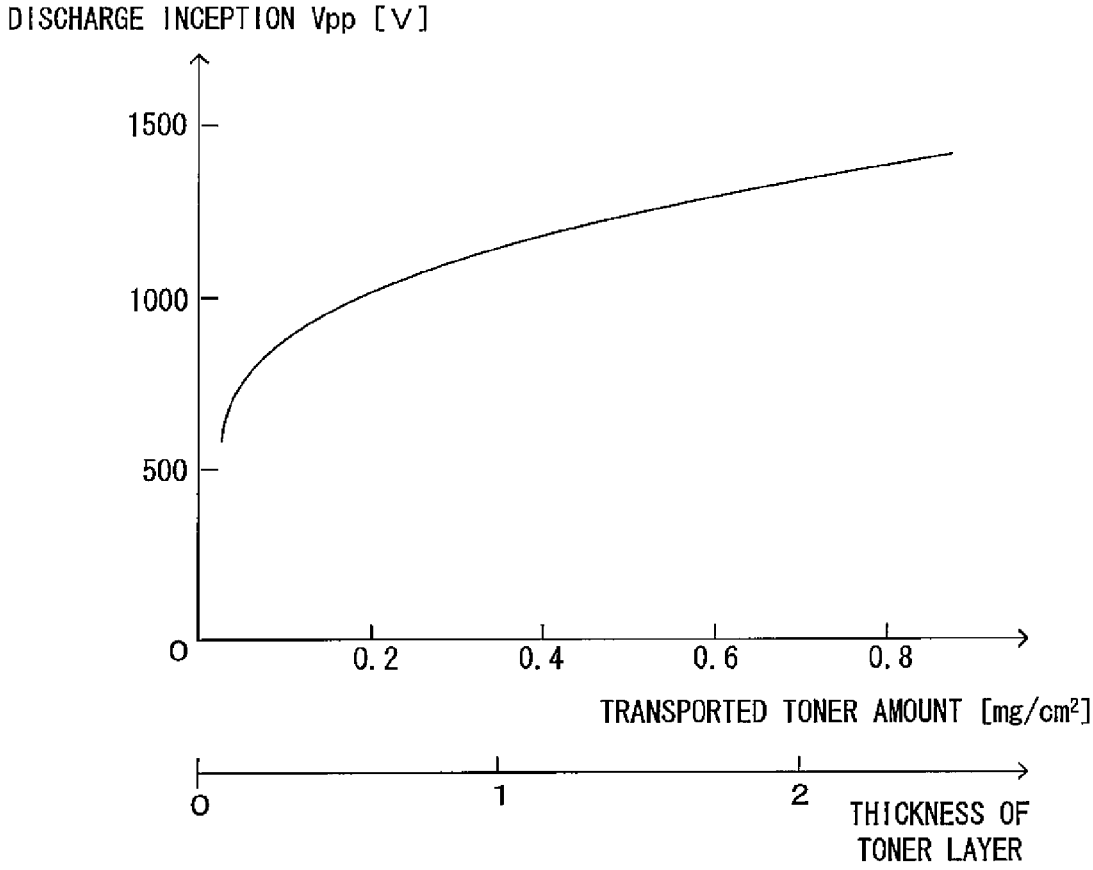
FIG. 7 is a graph showing the relationship between the transported toner amount and the discharge inception voltage.

FIG. 7 is a graph showing the relationship between the transported toner amount and the discharge inception voltage. Describing this in more detail, FIG. 7 is a graph showing how much increase of the peak-to-peak voltage Vpp of the developing bias Vb initiates discharge with a transported toner amount per unit area of the surface of the developing roller 44 set to various values. The minimum value of the voltage Vpp which gives rise to discharge in response to each value of the transported toner amount is called "discharge inception Vpp" for each transported toner amount. As shown in FIG. 7, the smaller the transported toner amount is on the surface of the developing roller 44, the lower the discharge inception Vpp is, and further, the discharge inception Vpp sharply decreases in a region where the transported toner amount is small. The discharge inception Vpp sharply decreases in the case where the toner layer on the surface of the developing roller is less than one toner layer and the surface gets partially exposed. This shows that coating of the surface of the metallic developing roller 44 with toner which is an insulator makes it possible to increase the discharge inception Vpp and to suppress discharge within the developing gap DG.

As described above, it is desirable that the convex sections 441 do not carry toner to ensure a favorable toner layer carried on the developing roller 44. On the other hand, there is a contradicting demand that the convex sections 441 as well should carry toner for prevention of discharge. These demands however can be satisfied simultaneously. It is within the restriction nip that the convex sections 441 should not carry toner. Meanwhile, it is within the developing gap DG which is located on the downstream side to the restriction nip in the rotation direction D4 of the developing roller 44 that the convex sections 441 should carry toner.

Hence, after the convex sections 441 move past the restriction nip without carrying toner, toner may be made adhere to the convex sections 441 to coat the convex sections 441 before the convex sections 441 arrive at the developing gap DG. Further, for the purpose of maintaining a transported amount, a charge level and the like of toner restricted by the restriction blade 46, it is desirable that toner which is made adhere to the convex sections 441 is toner carried by the surface of the developing roller 44 which has moved past the restriction nip, namely, toner carried by the concave section 442. In this embodiment, toner carried by the concave section 442 which has moved past the restriction nip is made move to the convex sections 441 in the following manner.

Figure 8A:
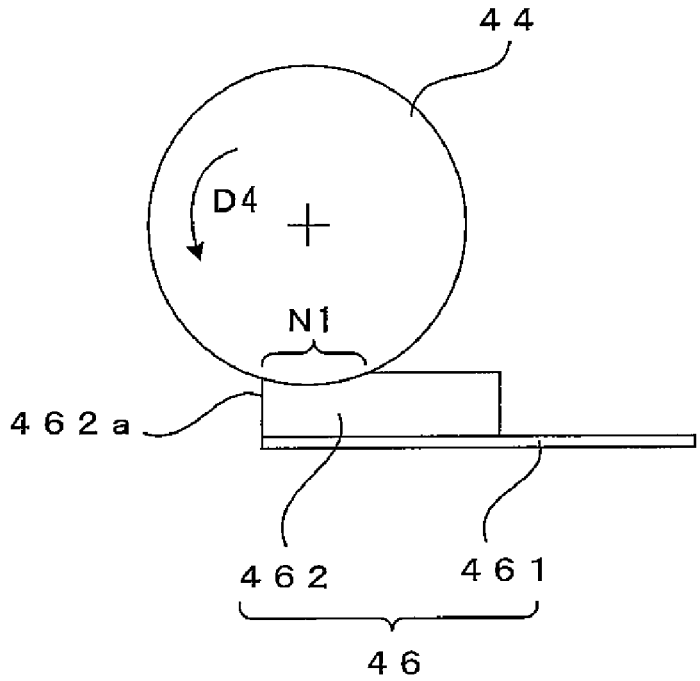
FIGS. 8A and 8B are diagrams showing a condition of the developing roller and the restriction blade abutting on each other.
Figure 8B:
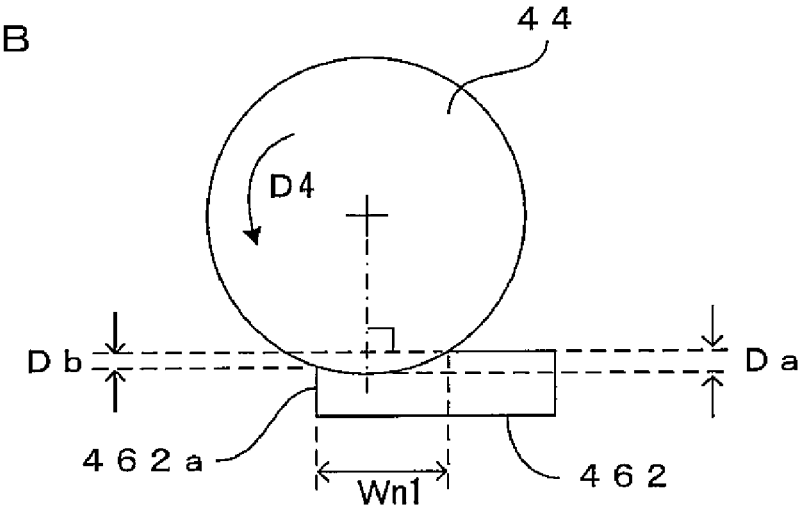

FIGS. 8A and 8B are diagrams showing a condition of the developing roller and the restriction blade abutting on each other. In this embodiment, as shown in FIG. 8A, the restriction blade 46 abuts on the surface of the developing roller 44 in a direction against the rotation direction D4 of the developing roller 44. The elastic member 462 at the tip end of the restriction blade 46 gets pressed by the surface of the developing roller 44 and partially and elastically deformed, whereby a restriction nip N1 is formed in which the surface of the developing roller 44 contacts the elastic member 462. Further, an upper edge of an upstream-side end 462*a* of the elastic member 462 in the rotation direction D4 of the developing roller 44 is within the restriction nip N1, and toner is regulated by means of the edge restriction.

As shown in FIG. 8B, the upstream-side end 462*a* of the elastic member 462 is located on the upstream side in the rotation direction D4 of the developing roller 44 relative to a perpendicular from the rotation center of the developing roller 44 to the top surface of the elastic member 462. Hence, the deformation Db of the elastic member 462 owing to elastic deformation in the vicinity of the upstream-side end 462*a* is somewhat smaller than the maximum deformation Da of the elastic member 462 in the vicinity of the foot of the perpendicular. The elastic member 462, positioned like this, contacts the developing roller 44 in a wide area within the top surface of the elastic member 462, which makes a restriction nip width Wn1 relatively wide.

Figure 9:
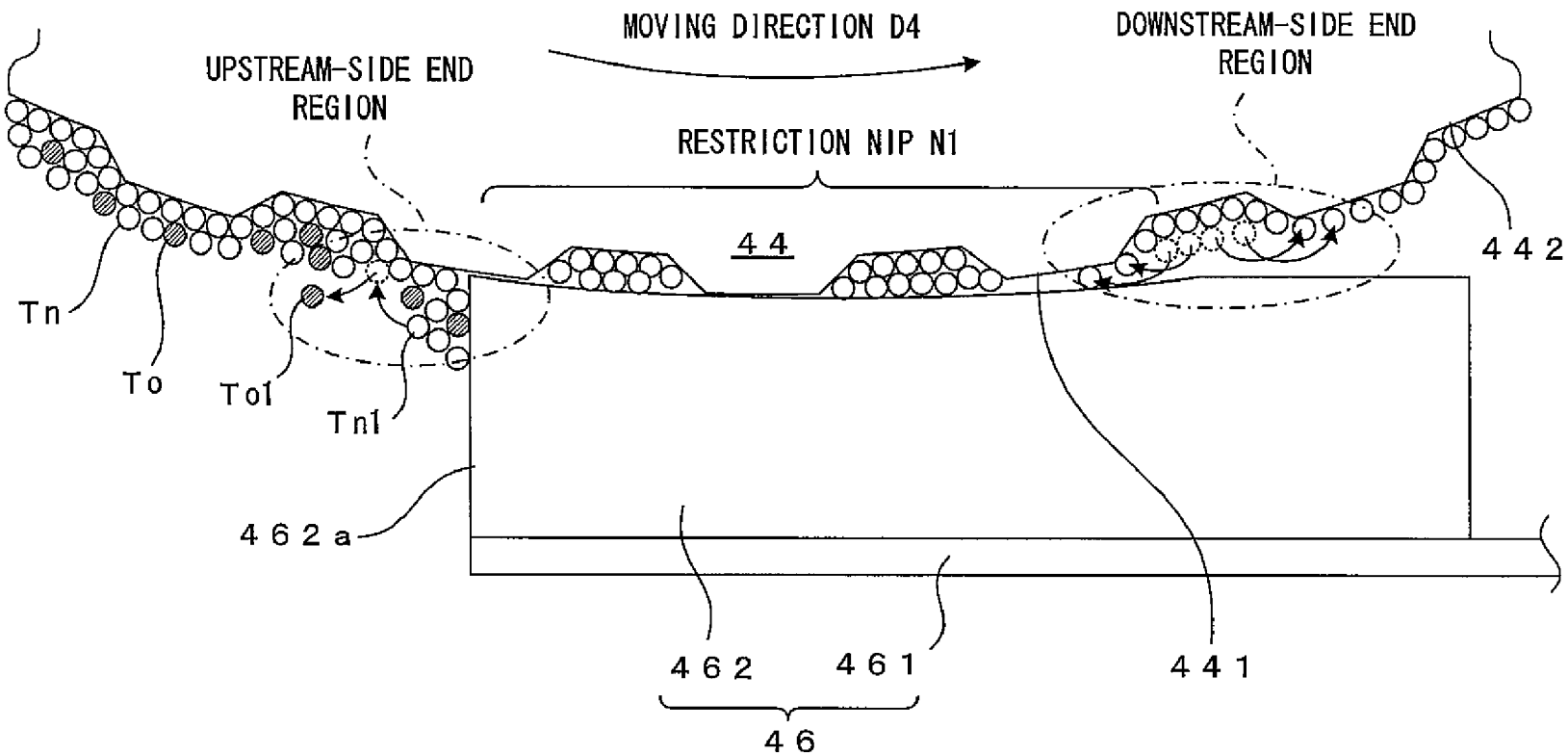
FIG. 9 is an enlarged schematic view of the restriction nip.

FIG. 9 is an enlarged schematic view of the restriction nip. In an upstream-side region to the restriction nip N1 in a moving direction D4 of the surface of the developing roller 44, a large amount of toner is accumulated right under the surface of the developing roller 44. This toner contains toner whose charge level is sufficient and toner having a low charge level due to degradation. In FIG. 9, favorably charged toner Tn is denoted at the white circles, whereas inadequately charged toner To is denoted at the shaded circles. Wile a layer of toner Tn whose charge level is high and whose electrostatic adhesion force to the developing roller 44 is strong is formed on the surface of the developing roller 44, a layer far from the surface of the developing roller 44 contains both favorably charged toner Tn and poorly charged toner To.

The elastic member 462 of the restriction blade 46 is pressed against the convex sections 441 of the developing roller 44. Hence, in an upstream-side end region of the restriction nip N1 in the moving direction D4 of the surface of the developing roller 44, the upstream-side end 462*a* of the elastic member 462 which is approximately perpendicular to the surface of the developing roller 44 scrapes off toner on the convex sections 441. On the other hand, toner entered into inside the concave section 442, not contacting the elastic member 462, will not get scraped off. In addition, since the upstream-side end 462*a* of the elastic member 462 is approximately perpendicular to the surface of the developing roller 44, toner thus scraped off stays near the upstream-side end region of the restriction nip N1 without the toner on the convex sections 441 getting pushed into the restriction nip N1 or scraped toner getting pushed away from the surface of the developing roller 44.

The toner thus scraped off from the convex sections 441 contains both favorably charged toner Tn and poorly charged toner To, and toner removed from near the surfaces of the convex sections 441 has a particularly high charge level. This is because toner which used to adhere to the surfaces of the convex sections 441 is mostly toner having a high charge level from the beginning, and because strong electrostatic force which attracts this toner toward the developing roller 44 acts upon this toner since the charge level of this toner increases due to friction contact with the restriction blade 46 during removal from the convex sections 441 and rolling. Hence, of toner scraped off by the elastic member 462, toner Tn1 having a high charge level flips toner To1 which is near the surface of the developing roller 44 and has a low charge level. In short, in the upstream-side end region of the restriction nip N1, toner To having a low charge level is gradually replaced with toner Tn1 having a high charge level and is driven away to behind. As a result, within the restriction nip N1 and on the downstream side to the restriction nip N1 in the rotation direction D4 of the developing roller, the concave section 442 alone carries toner, whereby the proportion of toner having a low charge level within the toner carried by the concave section 442 becomes extremely low and a toner layer is formed principally by toner having a high charge level.

On the other hand, on the rear side to the restriction nip N1, that is, in the downstream-side end region in the moving direction D4 of the surface of the developing roller 44, the elastic member 462 which used to abut on the convex sections 441 of the developing roller 44 gradually becomes separated from the convex sections 441. This liberates toner which was trapped inside the concave section 442 whose openings were closed by the elastic member 462 within the restriction nip N1 to move more freely. Toner not directly contacting the surface of the developing roller 44 in particular is under weak force which attracts it toward the developing roller 44 and can therefore easily move. In contrast, toner is under powerful attraction force at the convex sections 441 whose metallic surfaces are exposed. In consequence, toner at the concave section 442 partially moves toward and adheres to the convex sections 441 as denoted at the dotted arrows in FIG. 9. The convex sections 441 are thus covered with a part of toner which is carried by the concave section 442 and fulfills a discharge prevention function in the developing gap DG.

Figure 10A:
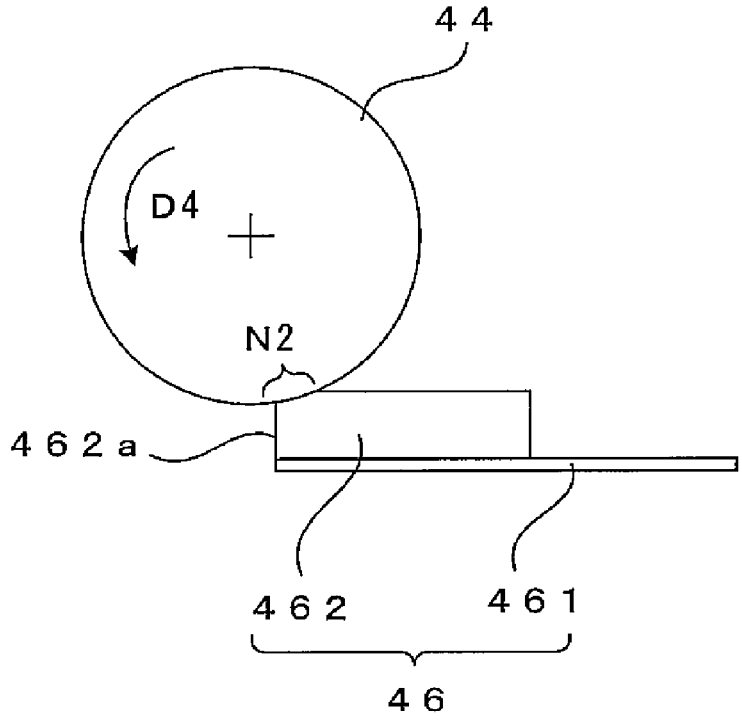
FIGS. 10A and 10B are diagrams showing a structure of a modified embodiment to enhance the effect of discharge prevention.
Figure 10B:
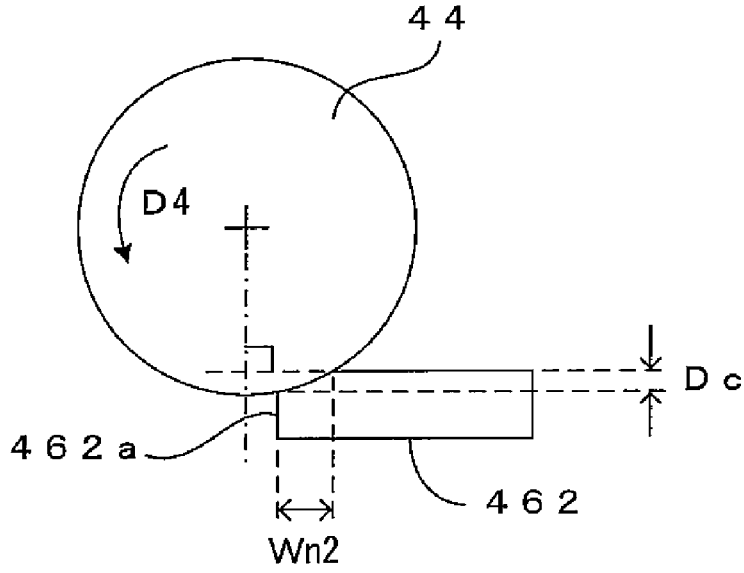

FIGS. 10A and 10B are diagrams showing a structure of a modified embodiment to enhance the effect of discharge prevention. As shown in FIG. 10A, in this modification as well, the restriction blade 46 abuts on the surface of the developing roller 44 in a direction against the rotation direction of the developing roller, and accordingly a restriction nip N2 is formed. As shown in FIG. 10B however, the upstream-side end 462*a* of the elastic member 462 is located on the downstream side in the rotation direction D4 of the developing roller 44 relative to a perpendicular from the rotation center of the developing roller 44 to the top surface of the elastic member 462. The deformation of the elastic member 462 owing to elastic deformation therefore has a maximum value Dc at the upstream-side end 462*a*. In other words, the elastic member 462 is elastically deformed most significantly at its upstream-side end. Further, the elastic member 462 contacts the developing roller 44 in only a small area, which makes a restriction nip width Wn2 narrower than the restriction nip width Wn1 which the first embodiment provides.

Figure 11:
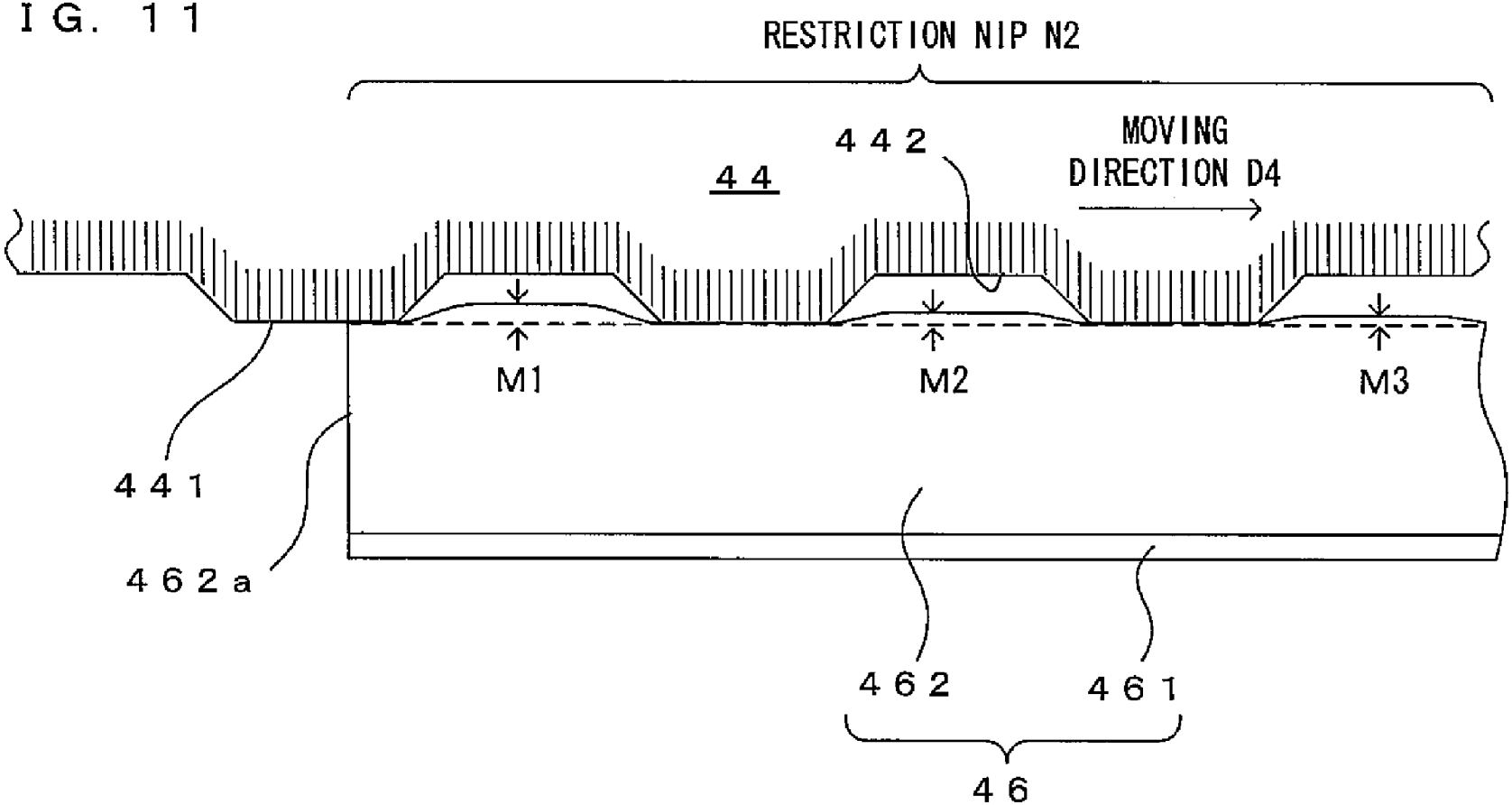
FIG. 11 is an enlarged diagram schematically showing the restriction nip in this modified embodiment.

FIG. 11 is an enlarged diagram schematically showing the restriction nip in this modified embodiment. Since the elastic member 462 is elastically deformed most significantly at its upstream-side end as described above, in the vicinity of the upstream-side end of the restriction nip N2, the greatest abutting pressure acts upon sections of the elastic member 462 which are opposed against the convex sections 441 of the developing roller 44. On the contrary, sections opposed against the concave section 442 of the developing roller 44 are not exposed to any pressure. Due to this, the sections of the elastic member 462 opposed against the concave section 442 bend toward the bottom of the concave section 442 (toward above in FIG. 11) and the surface of the elastic member 462 swells up in the spaces facing the concave section 442 as shown in FIG. 11. The amount of the bending becomes greatest at the upstream-side end of the restriction nip N2 which is under the largest abutting pressure but decreases with a distance toward the downstream side. In short, the following relationship holds true:

$$M1>M2>M3 \quad \text{(Formula 1)}$$

This relationship holds true also when there is only one concave section 442 which is enclosed within the restriction nip, and the amount of the bending decreases with a distance toward the downstream side even within one concave section 442.

The elastic member 462 bulging toward the concave section 442 allows transportation of a toner layer whose thickness corresponds to the distance between the surface of the elastic member 462 and the concave section 442 from among toner carried by the concave section but removes other toner. The amount of the bending decreases toward the downstream side in the rotation direction D4 of the developing roller 44 as described above. Therefore, the volume of the space enclosed by the concave section 442 of the developing roller 44 and the elastic member 462 of the restriction blade 46 is the smallest on the upstream-most side to the restriction nip N2 in the rotation direction D4 of the surface of the developing roller 44 and increases toward the downstream side. As a result, the pressure upon toner will never increase within the restriction nip, thereby making it easier on the downstream side for toner inside the concave section 442 to move.

Further, as the volume of the space enclosed by the concave section 442 of the developing roller 44 and the elastic member 462 of the restriction blade 46 increases, surrounding air flows into the concave section 442. In particular, the concave section 442 is provided as mesh-like groove surrounding the plurality of convex sections 441 as shown in FIG. 5. Hence, although each part of the concave section 442 seems to be mutually independent in FIG. 5, is communicated with each other in reality. Therefore, air flows in from around through the groove. Since the airflow further enhances fluidity of toner, the toner more actively moves from the concave section 442 to the convex sections 441.

As described above, in this embodiment, toner which adheres to the convex sections 441 is removed at the upstream-side end of the restriction nip N1 or N2 in the rotation direction D4 of the developing roller 44 and toner is carried only by the concave section 442. Toner carried by the concave section 442 is partially moved to the convex sections 441 at the downstream-side end of the restriction nip in the rotation direction D4 of the developing roller 44 after moving past the restriction nip to cover the convex sections 441. Hence, within the restriction nip, it is possible to prevent excessive charging of toner, filming and the like which are attributable to application of excessive pressing force upon toner on the convex sections 441.

Meanwhile, since the convex sections 441 carry toner once again before the developing gap DG, the developing roller 44 is prevented from getting located opposed against the photosensitive member 22 in a condition that its metallic portions are exposed, which makes it possible to obviate discharge between the developing roller 44 and the photosensitive member 22 within the developing gap DG. As a result, it is possible to set an AC component Vpp of the developing bias Vb high in this embodiment. Hence, it is possible to obtain an excellent image quality by allowing a sufficient amount of toner to jump across the developing gap DG.

Figure 12A:
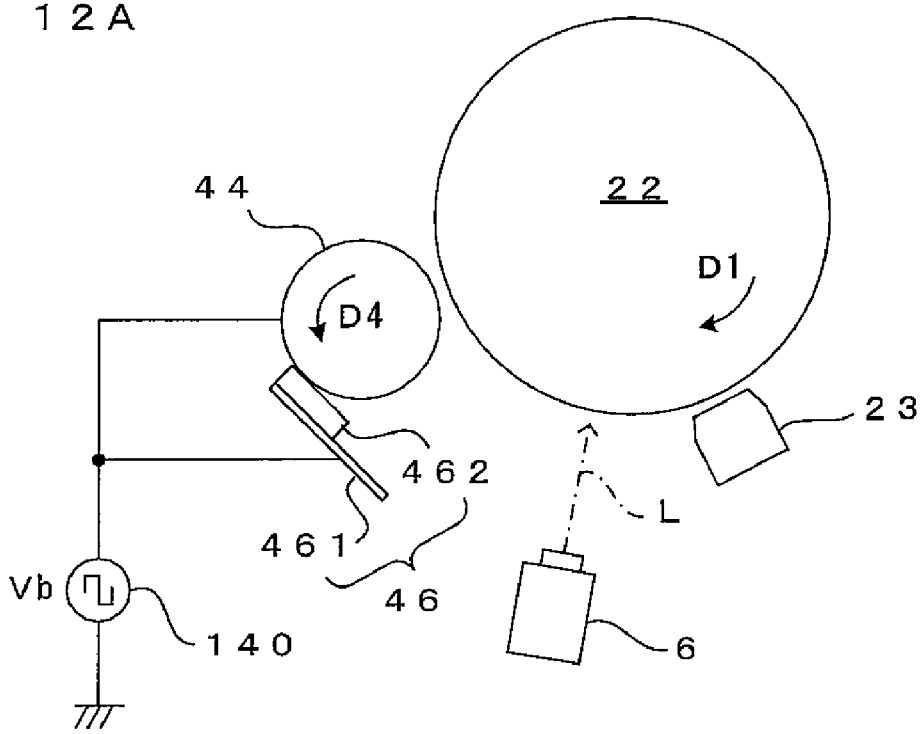
FIGS. 12A and 12B are diagrams showing image forming apparatuses of a second and a third embodiments according to the invention, respectively.
Figure 12B:
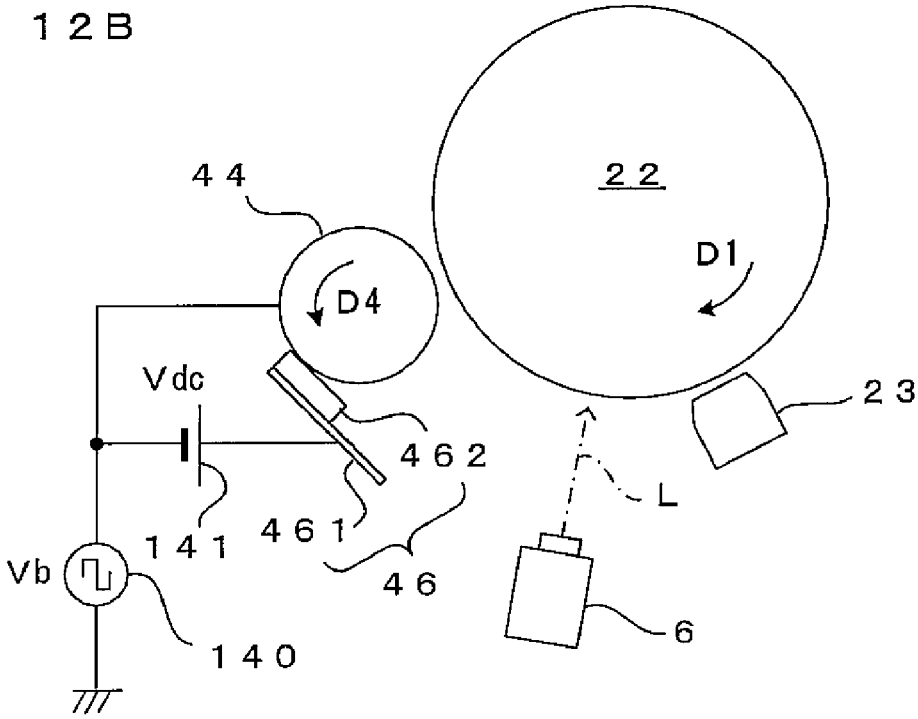

FIGS. 12A and 12B are diagrams showing image forming apparatuses of a second and a third embodiments according to the invention, respectively. The image forming apparatus of the first embodiment described above utilizes the elasticity of the restriction blade 46 in moving toner from the concave section 442 to the convex sections 441 in the downstream-side end region of the restriction nip. In the second and the third embodiments described below, application of a bias potential upon the restriction blade 46 more positively facilitates moving of toner from the concave section 442 to the convex sections 441. The structures and the basic operations of the apparatuses are the same as those according to the first embodiment except of this, and therefore, the same structures will not be described but will be simply denoted at the same reference symbols.

In the second embodiment shown in FIG. 12A, the restriction blade 46 receives the same potential as the developing bias Vb which is applied to the developing roller 44. Meanwhile, in the third embodiment shown in FIG. 12B, a DC power source 142 which generates a DC potential Vdc is provided and a potential which is the sum of the developing bias Vb and the DC potential Vdc is applied to the restriction blade 46. In the third embodiment, the DC potential Vdc is determined such that the restriction blade 46 is at a higher DC potential (that is, a positive potential) than the developing roller 44. This is because of the fact that toner to use is negatively-charged toner. In the event that positively-charged toner is used, the restriction blade 46 is made to stay at a lower DC potential (that is, a negative potential). In short, it is desirable that the DC potential of the restriction blade 46 relative to the developing roller 44 has the polarity opposite to the polarity which toner is charged to.

In these embodiments, it is desirable that the elastic member 462 disposed in the restriction blade 46 is conductive. For instance, carbon dispersed in urethane rubber whose hardness is roughly 70 degrees measured in accordance with JIS (Japanese Industrial Standards)-A to achieve the specific resistance of approximately $10^6$ Ω·cm may be used as the elastic member 462. Although the specific resistance of the elastic member 462 is not limited to the above value, a favorable result is obtained when the specific resistance is $10^8$ Ω·cm or lower according to experiments by the inventor of the invention. Further, connection of a plate-like member 461 made of a metal plate with a power source makes it possible to provide the same potential to the entire elastic member 462.

To prevent charging of the elastic member 462 by the friction contact of the elastic member 462 with the developing roller 44, it is preferable to use a similar material in the first embodiment as well. In this respect, the structure of the restriction blade 46 may be the same among the first through the third embodiments.

Figure 13A:
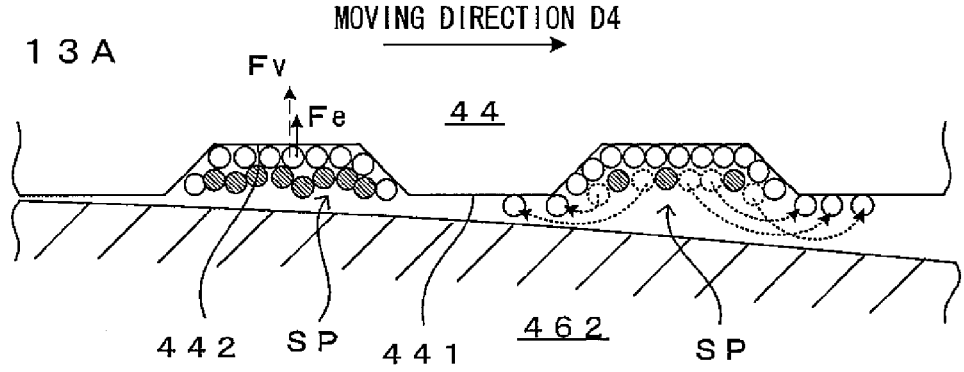
FIGS. 13A to 13C are diagrams schematically showing a condition of movement of toner to the convex sections in the second and the third embodiments.
Figure 13B:
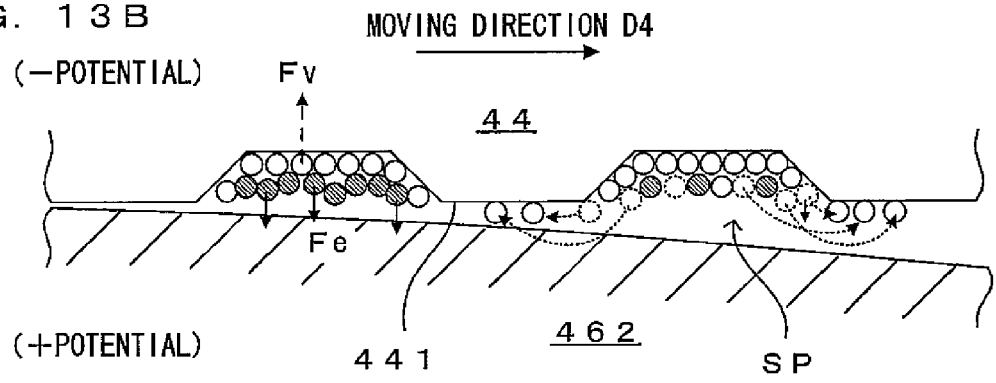
Figure 13C:
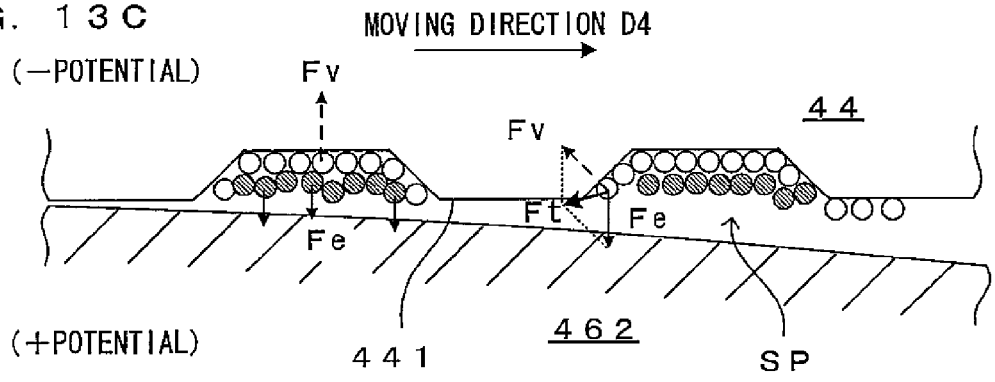

FIGS. 13A to 13C are diagrams schematically showing a condition of movement of toner to the convex sections in the second and the third embodiments. In the second embodiment which applies the same potential to the elastic member 462 of the restriction blade 46 as the potential applied to the developing roller 44, no electric field will be developed in a space SP between the elastic member 462 and the surface of the developing roller 44. As shown in FIG. 13A, of toner carried by the concave section 442, an electrostatic force Fe denoted at the solid-line arrows and a van der Waals' force Fv denoted at broken-line arrows act between the developing roller 44 and toner directly contacting the developing roller 44 (denoted at the white circles).

Meanwhile, such forces which act upon toner carried by but separated from the surface of the developing roller 44 (denoted at the shaded circles) are weak, and hence, the toner is not bound strongly to the surface of the developing roller 44. When the distance between the elastic member 462 and the developing roller 44 is increased at the rear end of the restriction nip, weakly bound toner is easy to flow in the vicinity of the concave section 442, and hence, this toner rolls on the surface of a toner layer directly contacting the surface of the developing roller 44 and moves to exposed portions of the surface of the developing roller 44 which are under strong van der Waals' force and the like. In FIGS. 13A to 13C, the movement of toner is denoted at dotted-line arrows. Toner rolling from the concave section 442 adheres one after another to these exposed surface portions of the convex sections 441 of the developing roller 44 in this fashion, whereby the convex sections 441 are covered with the toner and discharge within the developing gap DG is prevented.

In the third embodiment which applies a higher potential to the restriction blade 46 than to the developing roller 44, an electric field develops in the space SP between the elastic member 462 and the surface of the developing roller 44. Hence, as shown in FIG. 13B, electrostatic force Fe acts upon toner which is separated from the surface of the developing roller 44 to attract the toner toward the elastic member 462. This makes it easy for toner in the concave section 442 to roll out and movement of toner to the convex sections 441 is enhanced.

Meanwhile, in the case where a higher potential is applied to the elastic member 462 than to the developing roller 44, as shown in FIG. 13C, toner adhering to slopes 443 connecting the convex sections 441 and the concave section 442 within the surface of the developing roller 44 is acted upon by van der Waals' force Fv in a direction orthogonal to the slopes 443 and electrostatic force Fe in a direction toward the elastic member 462. Hence, toner is subjected to force Ft which results from these forces and contains a component in a direction toward the convex sections 441. Therefore, it is easy for toner to move away from the slopes 443. This is preferable in facilitating the movement of toner toward the convex sections 441. However, when toner adhering to the slopes 443 moves one after another to the convex sections 441, the slopes 443 may get exposed and the discharge prevention effect could be weakened. Particularly when a potential difference between the elastic member 462 and the developing roller 44 is too large or the concave section 442 carries merely an insufficient amount of toner, exposure of the slopes 443 becomes significant.

In reality, according to the inventor's observation of carrying of toner on the surface of the developing roller 44 with the potential upon the elastic member 462 set to various values, in a condition that the elastic member 462 and the developing roller 44 were at the same potential or the elastic member 462 was at a slightly higher potential, a thin and approximately uniform toner layer was formed on both the convex sections 441 and the slopes 443. On the contrary, in the case where the potential difference was increased up to approximately 100 V, the amount of toner on the convex sections 441 increased but the amount of toner adhering to the slopes 443 decreased and some slopes 443 were partially exposed.

FIGS. 14A and 14B are graphs showing cross sectional profiles of the developing roller after the developing roller has moved past the restriction nip. To be more precise, FIGS. 14A and 14B are graphs showing the cross sectional profiles measured near the surface of the developing roller 44 after the developing roller 44 has moved past the restriction nip. In FIGS. 14A and 14B, the difference of the profiles between the surface of the developing roller and a toner transporting surface indicates that toner has adhered to the corresponding location. In the event that the elastic member 462 of the restriction blade 46 is made of an insulation material and no control over a potential is provided, as shown in FIG. 14A, a toner layer almost reaching the height of the convex sections is formed in the concave section, whereas the concave section retains merely few toner. On the contrary, in the case where the elastic member 462 is conductive and the same potential is applied to the elastic member 462 as that to the developing roller 44, as shown in FIG. 14B, while the thickness of a toner layer in the concave section decreases, toner adheres wholly to the convex sections.

As for the instance shown in FIG. 14B, the transported toner amount transported by the developing roller 44 remained unchanged from what it was within the restriction nip, and it was confirmed that within the restriction nip, toner covering the convex sections 441 after the restriction nip with a potential applied to the elastic member 462 was toner which used to be carried by the concave section 442 but had moved. Hence, it is preferable that the elastic member 462 and the developing roller 44 are at the same potential or the potential upon the elastic member 462 is slightly higher (by about several tens of volts).

As described above, in these embodiments, a bias potential is applied upon the restriction blade 46 to further encourage toner to flow out from the concave section 442 and to move toward the convex sections 441. Hence, in these embodiments as well, as in the first embodiment, covering of the convex sections 441 with toner behind the restriction nip makes it possible to prevent discharge within the developing gap DG while prohibition of carrying of toner by the convex sections 441 within the restriction nip makes it possible to prevent degradation and the like of toner.

Figure 15A:
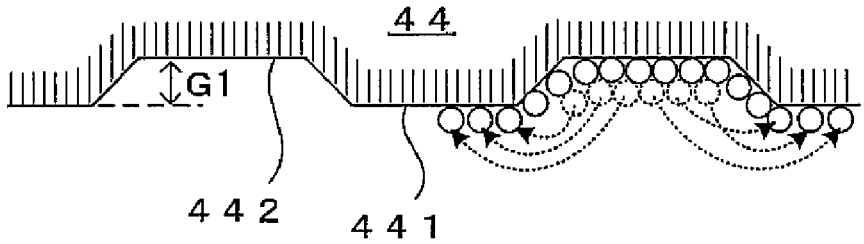
FIGS. 15A and 15B are diagrams schematically showing the relationship between a height difference on the surface of the developing roller and toner carried on the surface of the developing roller.
Figure 15B:
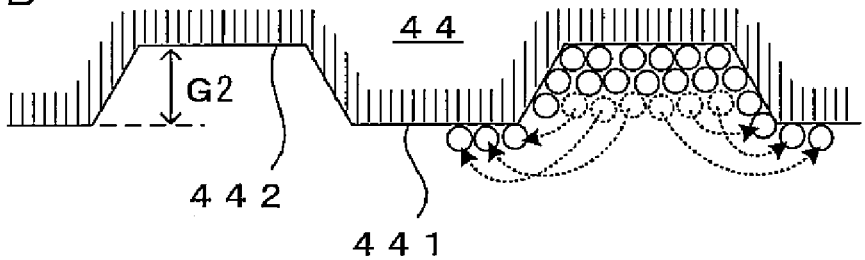

FIGS. 15A and 15B are diagrams schematically showing the relationship between a height difference on the surface of the developing roller and toner carried on the surface of the developing roller. In each embodiment described above, for the purpose of carrying toner by the concave section 442 with the elastic member 462 abutting on the convex sections 441, the height difference between the convex sections 441 and the concave section 442, or more strictly describing, the distance between the concave section 442 and the front edge of the elastic member 462 needs be equal to or larger than the volume average particle diameter of toner. The volume average particle diameter of toner will be hereinafter denoted at "Dave". It is desirable that the distance G1 between the concave section 442 and the elastic member 462 is twice the volume average particle diameter of toner Dave or larger as shown in FIG. 15A. This ensures that the concave section 442 carries two or more layers of toner on the average within the restriction nip. In this manner, it is possible to ensure enough toner which do not directly contact the surface of the developing roller 44 and to move an adequate amount of toner toward the convex sections 441. It is also possible to leave at least one toner layer in the concave section 442.

Alternatively, the distance G1 between the concave section 442 and the elastic member 462 may be triple the volume average particle diameter of toner Dave or larger. In this instance, as shown in FIG. 15B, the concave section 442 carries three or more toner layers on the average. Hence, even when one layer of toner layers carried by the concave section 442 within the restriction nip moves to the convex sections 441, the concave section 442 still retain two or more toner layers. Toner of the second and farther layers carried on the developing roller 44 can more easily leave the developing roller 44 than toner of the first layer directly contacting the developing roller 44 can. Therefore, the toner of the second and farther layers is made carried by the concave section 442 and transported to the developing gap Dg in this way, and hence, it is possible to improve the efficiency of development.

For complete coverage of the convex sections 441 with toner carried by the concave section 442, it is desirable to set the area ratio between the convex sections 441 and the concave section 442 as described below. In principle, it is necessary that of toner carried by the concave section 442, toner which does not contact the developing roller 44 and is therefore movable is available in a sufficient amount for forming one or more toner layers on the convex sections 441. Therefore, the total volume of movable toner carried by the concave section 442 on the entire developing roller 44 may be equal to or larger than a value which is calculated by multiplying the total area of the convex sections 441 on the entire developing roller 44 by the volume average particle diameter Dave of toner. Presuming for approximate calculation that toner carried by the slopes 443 does not move, when the height difference between the convex sections 441 and the concave section 442 is twice the volume average particle diameter Dave of toner for example, the area ratio of the area of the convex sections 441 to the sum of the area of the convex sections 441 and that of the concave section 442 on the entire developing roller 44 may be approximately 50% or less. Further, in the event that the height difference between the convex sections 441 and the concave section 442 is triple the volume average particle diameter Dave of toner for example, the area ratio may be approximately 67% or less.

While the particle diameter of toner to use in each embodiment described above is not limited in particular, the resulting effect is remarkable particularly when small-diameter toner is used. "Small-diameter toner" refers herein to toner whose volume average particle diameter is approximately 5 μm or smaller for instance.

Figure 16:
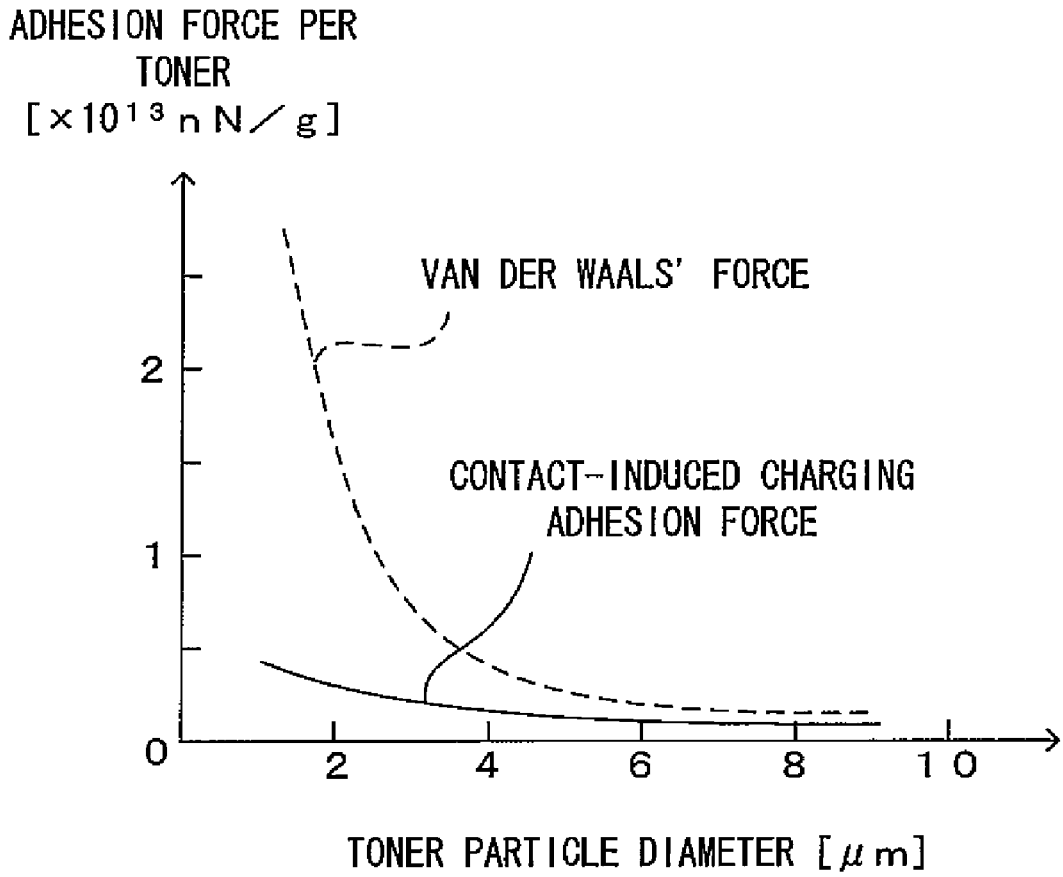
FIG. 16 is a graph showing the relationship between the particle diameter of toner and adhesion force to the developing roller.
Figure 17:
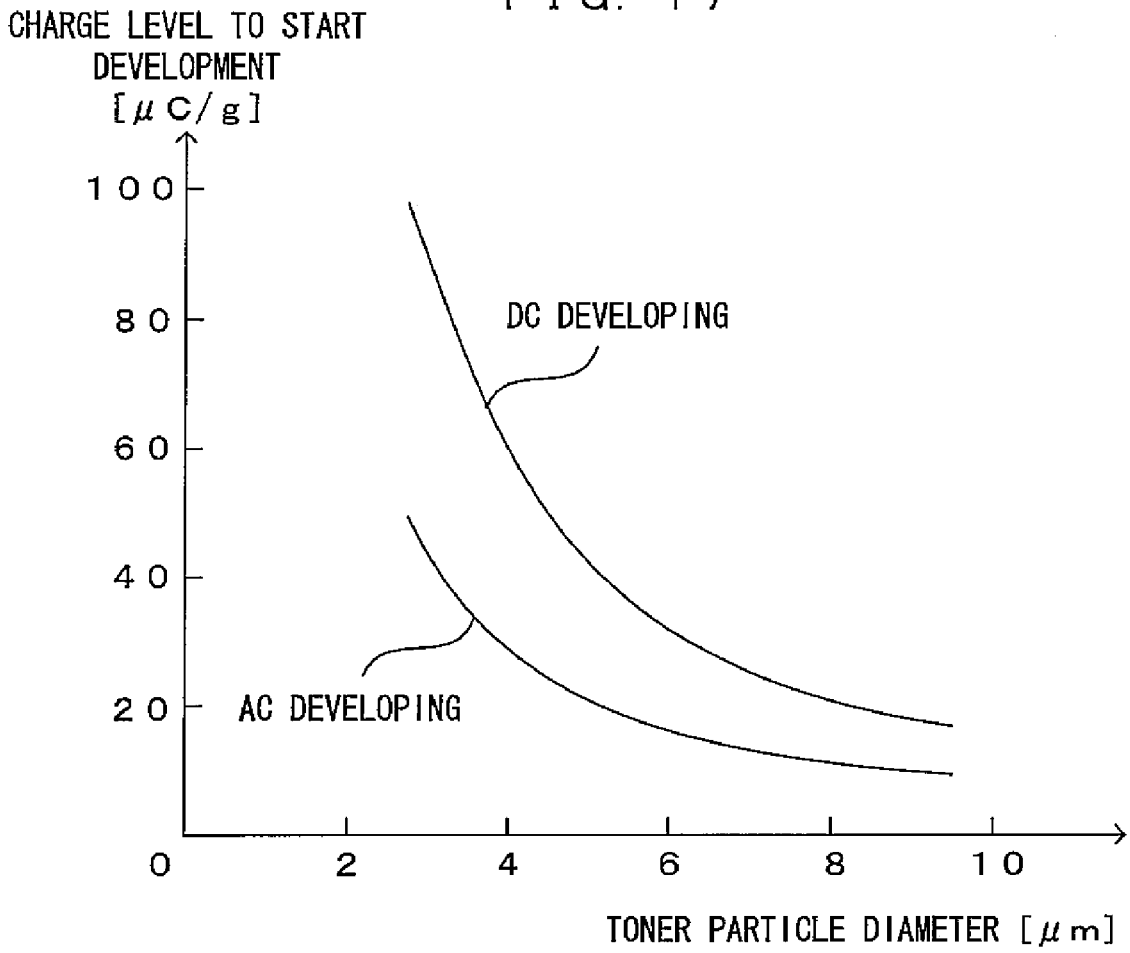
FIG. 17 is a graph showing the relationship between the particle diameter of toner and a charge level to start the development.

FIG. 16 is a graph showing the relationship between the particle diameter of toner and adhesion force to the developing roller FIG. 17 is a graph showing the relationship between the particle diameter of toner and a charge level to start the development. As shown in FIG. 16, there is no big difference between van der Waals' force which acts between toner and the developing roller 44, and adhesion force attributable to contact-induced charging when the particle diameter of toner is large. However, as the particle diameter of toner becomes smaller, van der Waals' force increases and becomes dominant particularly when the particle diameter of toner is 5 μm or smaller. In the event that the concave section 442 carries such toner, toner carried at a separated location from the developing roller 44 intensifies its tendency to move to the exposed surface of the developing roller 44, whereby toner more easily moves to the convex sections 441 and great discharge prevention effect is achieved.

In addition, as shown in FIG. 17, whichever method is used between a DC developing method in which a DC voltage is applied as the developing bias and an AC developing method in which a voltage containing an AC component is applied, the smaller the particle diameter of toner is, the higher the charge level to start the development becomes, and when the particle diameter is 5 μm or smaller in particular, the charge level to start the development sharply increases. Here, the charge level to start the development is a minimum necessary level of an electric charge to be applied upon toner in order to make toner jump from the developing roller 44 owing to the action of the developing bias. The relationship indicates that toner having a small particle diameter would not easily move away from the surface of the developing roller 44. The condition that toner would not easily move away from the surface of the developing roller 44 reduces the proportion of toner which moves from the developing roller 44 to an electrostatic latent image on the photosensitive member 22 at the developing gap DG, that is, the efficiency of development.

Hence, in order to improve the efficiency of development and to obtain a sufficient image density when toner having a small particle diameter is used, it is necessary to provide an adequate charge level to toner and to increase the developing bias. Since toner having a small particle diameter tends hard to get charged, the developing bias should be as large as possible in reality. Meanwhile, an increased developing bias would more easily cause discharge within the developing gap DG as described earlier. To cope with these mutually contradicting demands, toner is moved from the concave section 442 to the convex sections 441 at a location behind the restriction nip to cover the convex sections 441 with the toner as in each embodiment described above. Hence, it is possible to ensure a high efficiency of development with application of a sufficient developing bias potential while preventing discharge within the developing gap DG.

Further, the higher the fluidity of toner is, more easily the toner rolls at a location behind the restriction nip. That is, the discharge prevention effect according to the invention is particularly remarkable when highly fluid toner is used. In the event that toner whose coverage ratio of an additive for enhancing the fluidity to a toner particle is 100% or more is used for instance, great discharge prevention effect is attained. In addition, while the fluidity becomes higher as degree of circularity of toner is higher, according to the experiments by the inventor of the invention, great discharge prevention effect was attained when toner whose degree of circularity was 0.94 or more was used. In this respect, it is more desirable to use toner manufactured by a polymerization method which can obtain toner whose degree of circularity is higher than toner manufactured by a crashing method.

As described above, in the embodiments above, the developer 4K, . . . correspond to the "developer apparatus" of the invention. The housing 41, the developing roller 44 and the restriction blade 46 function respectively as a "container", a "toner carrier roller" and a "restriction member" of the invention. The elastic member 462 provided in the restriction blade 46 functions as an "elastic abutting member" of the invention. In addition, in the image forming apparatuses in the embodiments above, the developer 4K, . . . , the photosensitive member 22 and a bias power source 140 function respectively as a "developer", an "image carrier" and a "bias applier".

It should be noted that the invention is not limited to the embodiments above, but may be modified in various manners in addition to the embodiments above, to the extent not deviating from the object of the invention. For example, although the convex sections 441 of the developing roller 44 are lozenge-shaped in the above embodiments, this is not limiting. The convex sections may be shaped differently such as circles and triangles for instance.

Although the developing roller 44 is metallic cylinder in the above embodiments, the invention is also applicable to an apparatus comprising a developing roller made of other material. However, experiments performed by the inventor of the invention have identified that the effect of applying the invention was remarkable when a developing roller whose surface is made of a conductive material such as a metallic developing roller and a developing roller made of non-metal with metal-plating thereon is used. In this respect, the invention is also effective to an apparatus comprising a developing roller which is made conductive by dispersing a conductive material such as carbon black and metallic fine powder in a cylinder made of rubber, resin or the like for instance.

Further, although the restriction blade 46 is prepared by attaching the elastic member 462 made of resin to a plate-like member 461 made of metal in the embodiments above, this structure is not limiting. The restriction blade may be a plate of metal alone or a metal plate coated with resin, for example.

The image forming apparatus in each of the above embodiments is a color image forming apparatus in which the developers 4K, . . . are attached to the rotary developer unit 4 and toner inside the developers is mixed when the developers 4K, . . . rotate. However, the application of the invention is not limited to this as mentioned earlier. The invention is also applicable to a monochromatic image forming apparatus which includes only one developer and forms a monochromatic image for example. Particularly, the invention is favorably applied to an apparatus which is capable of replenishing toner by a user or an operator through a replenishing slot which is provided in the developer, and to an apparatus which is structured that toner is regularly replenished from a toner tank and the like separately provided from the developer.

In an embodiment according to the invention, for instance, the restriction member may include an elastic abutting member which is made of an elastic material, is pressed against the surface of the toner carrier roller to form the restriction nip, an upstream-side edge surface of the elastic abutting member in the rotation direction of the toner carrier roller may be upright approximately perpendicularly to the surface of the toner carrier roller, and a volume of the elastically-deformed elastic abutting member entering into the concave section of the toner carrier roller may be less at a downstream side than at an upstream side in the rotation direction of the toner carrier roller.

According to this structure, the closer toward the downstream side in the restriction nip, the weaker the pressing force becomes which is applied upon toner within the concave section by the elastic abutting member which moves into inside the concave section in the restriction nip. At the downstream side to the restriction nip, the pressing force is zero. In addition, the volume of the space defined between the concave section and the restriction member increases with a distance toward the downstream side. In this way, the pressure upon toner wanes more toward the downstream side within the restriction nip and the volume of the space which carries toner increases. Hence, toner carried on the concave section has higher fluidity toward the downstream side. This effect is more remarkable particularly when the concave section is communicated with each other in the restriction nip, that is, when the concave section forms a single space in the restriction nip. In consequence, at the downstream side to the restriction nip, toner carried on the concave section partially moves toward the exposed convex sections not carrying toner and covers the convex sections.

In an embodiment according to the invention, for instance, an upstream-side end of the elastic abutting member in the rotation direction of the toner carrier roller may abut on the convex sections of the toner carrier roller, and a volume of deformation of the elastic abutting member which is elastically deformed when abutting on the toner carrier roller may be maximum at the upstream-side end. With such a structure, a volume of the elastic member entering into the concave section can be greater at the upstream side within the restriction nip as described earlier.

A same potential as that applied to the toner carrier roller may be applied to the restriction member. With such a structure as well, it is possible to partially move toner carried on the concave section to the convex sections. When the same potential is applied to the restriction member and the toner carrier roller, toner carried on the concave section of the toner carrier roller is subjected to weak electrostatic binding force toward the toner carrier roller. Hence, fluidity of the toner carried on the concave section is further enhanced. Toner rolling out from the concave section adheres to the convex sections of the toner carrier roller due to van der Waals' force, image force and the like.

Further, a potential may be applied upon the restriction member whose polarity relative to a potential applied upon the toner carrier roller is opposite to a polarity of the charged toner. With such a structure, since toner carried on the concave section is attracted to the restriction member owing to electrostatic force, rolling of toner from the concave section is further facilitated.

In a structure in which a potential is applied to the restriction member, the restriction member may include an elastic abutting member which is made of an elastic material whose specific resistance is $10^8$ Ω·cm or lower, is pressed against the surface of the toner carrier roller to form the restriction nip. This structure makes it possible to extract toner carried on the concave section within the restriction nip and to move the toner to the convex sections.

It is desirable that a height difference between the convex sections and the concave section within the surface of the toner carrier roller is equal to or larger than twice a volume average particle diameter of toner. It is therefore possible for the concave section to carry two or more toner layers within the restriction nip. In the toner layers, toner not directly contacting the toner carrier roller is under weak electrostatic binding force and can therefore easily move to the convex sections.

The height difference between the convex sections and the concave section may preferably be equal to or larger than triple the volume average particle diameter of toner. This ensures that the concave section retains a toner layer of approximately two layers even after toner carried on the concave section has partially moved to the convex sections. Adhesion force of toner not directly contacting the toner carrier roller to the toner carrier roller is relatively weak, and can therefore be efficiently utilized for development of an electrostatic latent image. In other words, it is possible to improve the efficiency of development.

The invention provides a remarkable effect in the event that the volume average particle diameter of toner is 5 μm or smaller. In toner having such a small particle diameter, adhesion force to the surface of the toner carrier roller is principally attributable to van der Waals' force. Due to this, at the downstream side to the restriction nip, toner can easily move around to exposed region of the surface of the toner carrier roller from which toner has been removed, thereby enhancing the discharge prevention effect.

Further, the effect of the invention is remarkable also when toner whose degree of circularity is 0.94 or more is used. Fluidity of such toner is high and any strong pressing force will not act upon toner carried on the concave section in the structure according to the invention. Hence, the concave section carries toner while the high fluidity of the toner is maintained. This makes it easy for toner carried on the concave section to move to the convex sections at the downstream side to the restriction nip, and hence, enhances the discharge prevention effect by covering the convex sections with toner.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A developer apparatus, comprising:

a container which houses toner;

a toner carrier roller that is provided, on a surface thereof, with a plurality of convex sections which are regularly arranged and a concave section which surrounds the convex sections, is shaped approximately like a cylinder, and rotates while carrying a toner layer of charged toner on the surface thereof; and a restriction member that abuts on the surface of the toner carrier roller to form a restriction nip, restricts a thickness of the toner layer carried on the surface of the toner carrier roller in the restriction nip, and removes the toner layer on the convex sections from among the toner layer carried on the surface of the toner carrier roller at an upstream-side end of the restriction nip in a rotation direction of the toner carrier roller, wherein an upstream-side end of the restriction member in the rotation direction of the toner carrier roller abuts on the convex sections, and a part of toner carried by the concave section moves to the convex sections to cover the convex sections with the toner at a downstream side to the restriction nip in the rotation direction of the toner carrier roller.

2. The developer apparatus of claim 1, wherein the restriction member includes an elastic abutting member which is made of an elastic material, is pressed against the surface of the toner carrier roller to form the restriction nip, an upstream-side edge surface of the elastic abutting member in the rotation direction of the toner carrier roller is upright approximately perpendicularly to the surface of the toner carrier roller, and a volume of the elastically-deformed elastic abutting member entering into the concave section of the toner carrier roller is less at a downstream side than at an upstream side in the rotation direction of the toner carrier roller.

3. The developer apparatus of claim 2, wherein an upstream-side end of the elastic abutting member in the rotation direction of the toner carrier roller abuts on the convex sections of the toner carrier roller, and a volume of deformation of the elastic abutting member which is elastically deformed when abutting on the toner carrier roller is maximum at the upstream-side end.

4. The developer apparatus of claim 2, wherein the concave section which surrounds the plurality convex sections which abut on the elastic abutting member within the restriction nip forms a single space.

5. The developer apparatus of claim 1, wherein a same potential as that applied to the toner carrier roller is applied to the restriction member.

6. The developer apparatus of claim 1, wherein a potential is applied upon the restriction member whose polarity relative to a potential applied upon the toner carrier roller is opposite to a polarity of the charged toner.

7. The developer apparatus of claim 5, wherein the restriction member includes an elastic abutting member which is made of an elastic material whose specific resistance is $10^8$ Ω·cm or lower, is pressed against the surface of the toner carrier roller to form the restriction nip.

8. The developer apparatus of claim 1, wherein a height difference between the convex sections and the concave section within the surface of the toner carrier roller is equal to or larger than twice a volume average particle diameter of toner.

9. The developer apparatus of claim 8, wherein the height difference between the convex sections and the concave section is equal to or larger than triple the volume average particle diameter of toner.

10. The developer apparatus of claim 1, wherein a volume average particle diameter of toner is 5 μm or smaller.

11. The developer apparatus of claim 1, wherein a degree of circularity of the toner is 0.94 or more.

12. An image forming apparatus, comprising:

an image carrier that carries an electrostatic latent image;

a developer that includes a toner carrier roller and a restriction member, the toner carrier roller being provided, on a surface thereof, with a plurality of convex sections which are regularly arranged and a concave section which surrounds the convex sections, being made of a conductive material, being shaped approximately like a cylinder, and rotating while carrying a toner layer of charged toner on the surface thereof to transport the toner layer to an opposed position against the image carrier, the restriction member abutting on the surface of the toner carrier roller to form a restriction nip, and restricting a thickness of the toner layer carried on the surface of the toner carrier roller in the restriction nip; and a bias applier that applies a predetermined developing bias to the toner carrier roller to develop the electrostatic latent image carried on the image carrier with the toner, wherein an upstream-side end of the restriction member in a rotation direction of the toner carrier roller abuts on the convex sections, and toner is not carried on the convex sections within the surface of the toner carrier roller at an upstream-side end of the restriction nip in the rotation direction of the toner carrier roller, whereas toner carried on the concave section is partially moved to the convex sections to cover the convex sections at a downstream side to the restriction nip and at an upstream side to the opposed position against the image carrier in the rotation direction of the toner carrier roller.

13. A developing method, comprising:

rotating a toner carrier roller that is provided, on a surface thereof, with a plurality of convex sections which are regularly arranged and a concave section which surrounds the convex sections, is shaped approximately like a cylinder, and carries a toner layer of charged toner on the surface thereof to transport the toner layer to an opposed position against an image carrier which carries an electrostatic latent image;

developing the electrostatic latent image with the toner;

preventing the convex sections within the surface of the toner carrier roller from carrying toner at an upstream-side end of the restriction nip in a rotation direction of the toner carrier roller; and covering the convex sections with toner which has been carried on the concave section and has partially moved to the convex sections at a downstream side to the restriction nip and at an upstream side to the opposed position against the image carrier in the rotation direction of the toner carrier roller.

* * * * *